US009562392B2

(12) United States Patent
Plana et al.

(10) Patent No.: US 9,562,392 B2
(45) Date of Patent: Feb. 7, 2017

(54) FIELD REMOVABLE CHOKE FOR MOUNTING IN THE PISTON OF A ROTARY PERCUSSION TOOL

(71) Applicant: Varel International Ind., L.P., Carrollton, TX (US)

(72) Inventors: Anthony Plana, Prosper, TX (US); Amnach Kongamnach, Lavon, TX (US)

(73) Assignee: VAREL INTERNATIONAL IND., L.P., Carrollton, TX (US)

( * ) Notice: Subject to any disclaimer, the term of this patent is extended or adjusted under 35 U.S.C. 154(b) by 395 days.

(21) Appl. No.: 14/179,867

(22) Filed: Feb. 13, 2014

(65) Prior Publication Data

US 2015/0129317 A1 May 14, 2015

Related U.S. Application Data

(63) Continuation-in-part of application No. 14/079,342, filed on Nov. 13, 2013, now Pat. No. 9,404,342.

(51) Int. Cl.
*E21B 4/14* (2006.01)
*E21B 6/00* (2006.01)

(52) U.S. Cl.
CPC . *E21B 6/00* (2013.01); *E21B 4/14* (2013.01); *Y10T 29/4973* (2015.01); *Y10T 29/49721* (2015.01)

(58) Field of Classification Search
CPC ..... E21B 4/14; E21B 6/00
See application file for complete search history.

(56) References Cited

U.S. PATENT DOCUMENTS

| | | | | |
|---|---|---|---|---|
| 1,871,319 | A | 8/1932 | Griswold et al. | |
| 2,353,652 | A | 7/1944 | Coonrod | |
| 2,494,803 | A | 1/1950 | Frost et al. | |
| 2,591,130 | A * | 4/1952 | Brown | E21B 31/107 175/296 |
| 3,065,807 | A | 11/1962 | Wells | |

(Continued)

FOREIGN PATENT DOCUMENTS

| | | |
|---|---|---|
| WO | 9532355 | 11/1995 |
| WO | 9832945 | 7/1998 |

(Continued)

OTHER PUBLICATIONS

Thomas, Shane, International Search Report and Written Opinion of the International Searching Authority for PCT/US2015/014883, Apr. 15, 2015, pp. 1-8.

(Continued)

*Primary Examiner* — Giovanna C Wright

(57) ABSTRACT

A choke assembly for controlling air flow into a piston of a percussion tool for downhole drilling includes a choke and a choke adapter. The choke comprises a choke body and a choke opening in the choke body for fluid to flow therethrough. The choke further includes one or more arm slots formed into the choke body between an inner wall of the choke body and an outer wall of the choke body. The one or more arm slots are designed to receive one or more arms of a choke change tool. The choke adapter has an adapter opening extending through the choke adapter. The choke is sized to fit in the adapter opening. The choke is removable from the choke adapter after the choke is inserted into the adapter opening.

31 Claims, 26 Drawing Sheets

(56) References Cited

U.S. PATENT DOCUMENTS 3,101,796 A 8/1963 Stall et al.
3,265,091 A 8/1966 De Jarnett
3,311,177 A * 3/1967 Collier ..... E21B 4/14 173/133
3,353,607 A 11/1967 Kinley
3,379,261 A 4/1968 Martini
3,471,177 A 10/1969 Garrett et al.
3,586,104 A 6/1971 Hyde
3,638,970 A 2/1972 Sandquist et al.
3,664,441 A 5/1972 Carey
3,747,698 A 7/1973 Chapman
3,786,878 A 1/1974 Chapman
3,795,283 A 3/1974 Oughton
3,860,272 A 1/1975 Becker
3,928,903 A 12/1975 Richardson et al.
3,964,551 A 6/1976 Bassinger
3,970,335 A 7/1976 Curington et al.
3,998,479 A 12/1976 Bishop
4,012,061 A 3/1977 Olson
4,067,596 A 1/1978 Kellner et al.
4,070,043 A 1/1978 Becker
4,106,571 A 8/1978 Stone
4,149,739 A 4/1979 Morris
4,185,704 A 1/1980 Nixon, Jr.
4,190,073 A 2/1980 Claycomb
4,257,442 A 3/1981 Claycomb
4,280,535 A 7/1981 Willis
4,280,570 A 7/1981 Walter
4,281,678 A 8/1981 Claycomb
4,282,942 A 8/1981 Longmore
4,337,563 A 7/1982 Becker et al.
4,337,788 A 7/1982 Seger
4,385,668 A 5/1983 Becker et al.
4,444,220 A 4/1984 Seger
4,470,430 A 9/1984 Lancaster
4,565,394 A 1/1986 Becker
4,618,172 A 10/1986 Becker
4,644,974 A 2/1987 Zingg
4,662,401 A 5/1987 Zingg et al.
4,665,996 A 5/1987 Foroulis et al.
4,705,118 A 11/1987 Ennis
4,784,223 A 11/1988 Worrall et al.
4,819,746 A 4/1989 Brown et al.
4,872,507 A 10/1989 Ronco, Sr. et al.
4,913,466 A 4/1990 Becker
4,924,948 A * 5/1990 Chuang ..... B25D 17/24 173/211
4,951,409 A 8/1990 Froid
5,029,646 A 7/1991 Blizzard, Jr.
5,095,994 A 3/1992 Dollison
5,186,266 A 2/1993 Heller
5,190,106 A 3/1993 Johnston
5,217,046 A 6/1993 Woods
5,246,074 A 9/1993 Ayres
5,253,708 A 10/1993 Alexander
5,365,978 A 11/1994 Woods
5,396,965 A 3/1995 Hall et al.
5,505,261 A 4/1996 Huber et al.
5,535,767 A 7/1996 Schnatzmeyer et al.
5,562,357 A 10/1996 Sandell
5,623,966 A 4/1997 Rodger
5,713,423 A 2/1998 Martin et al.
5,862,866 A 1/1999 Springer
5,906,238 A 5/1999 Carmody et al.
5,957,207 A 9/1999 Schnatzmeyer
5,957,208 A 9/1999 Schnatzmeyer
5,992,520 A 11/1999 Schultz et al.
6,073,698 A 6/2000 Schultz et al.
6,082,458 A 7/2000 Schnatzmeyer
6,260,616 B1 7/2001 Carmody et al.
6,334,486 B1 1/2002 Carmody et al.
6,371,208 B1 4/2002 Norman et al.
6,450,255 B2 9/2002 Carmody et al.
6,484,800 B2 11/2002 Carmody et al.
6,612,547 B2 9/2003 Carmody et al.
6,659,202 B2 12/2003 Runquist et al.
6,668,935 B1 12/2003 McLoughlin et al.
6,715,558 B2 4/2004 Williamson
6,722,439 B2 4/2004 Garay et al.
6,860,330 B2 3/2005 Jackson
6,892,818 B2 5/2005 Mentesh et al.
6,966,380 B2 11/2005 McLoughlin et al.
6,973,974 B2 12/2005 McLoughlin et al.
7,025,140 B2 4/2006 McGee
7,134,514 B2 11/2006 Riel et al.
7,139,219 B2 11/2006 Kolle et al.
7,152,688 B2 12/2006 Richards
7,152,700 B2 12/2006 Church et al.
7,207,603 B2 4/2007 Segreto
7,225,875 B2 6/2007 Steele et al.
7,258,323 B2 8/2007 Dwivedi
7,350,565 B2 4/2008 Hall et al.
7,377,327 B2 5/2008 Jackson
7,389,830 B2 6/2008 Turner et al.
7,429,030 B2 9/2008 Dwivedi
7,451,825 B2 11/2008 Jonas
7,455,115 B2 11/2008 Loretz et al.
7,503,395 B2 3/2009 Meijer et al.
7,549,485 B2 6/2009 Radford et al.
7,575,058 B2 8/2009 Franco et al.
7,581,602 B2 9/2009 Lorger et al.
7,681,666 B2 3/2010 Radford et al.
7,712,540 B2 5/2010 Loretz et al.
7,748,478 B2 7/2010 Swadi
7,762,334 B2 7/2010 Posluszny et al.
7,762,356 B2 7/2010 Turner et al.
7,766,084 B2 8/2010 Churchill
7,770,645 B2 8/2010 Jeffryes
7,775,233 B2 8/2010 Baugh
7,832,473 B2 11/2010 Pensgaard
7,849,936 B2 12/2010 Hutton
7,870,906 B2 1/2011 Ali
7,939,142 B2 5/2011 Blue et al.
7,954,561 B2 6/2011 Tulloch et al.
7,980,265 B2 7/2011 Holmes et al.
RE42,772 E 10/2011 McGee
8,047,304 B2 11/2011 Radford
8,109,330 B1 2/2012 Miller
8,141,648 B2 3/2012 Darnell et al.
8,141,657 B2 3/2012 Hutton
8,186,444 B2 5/2012 Patel
8,196,679 B2 6/2012 Radford
8,220,563 B2 7/2012 Bangaru et al.
2004/0188146 A1 9/2004 Egerstrom
2006/0231150 A1 10/2006 Jamison
2008/0236842 A1 10/2008 Bhavsar et al.
2008/0236899 A1* 10/2008 Oxford ..... E21B 10/18 175/339
2009/0095471 A1 4/2009 Guignard et al.
2009/0151790 A1 6/2009 Ranjan et al.
2009/0283331 A1 11/2009 Heath
2010/0012380 A1 1/2010 Swadi
2010/0044111 A1* 2/2010 Marshall ..... E21B 4/14 175/293
2010/0270034 A1 10/2010 Clausen
2010/0288557 A1 11/2010 Radford
2010/0294495 A1 11/2010 Clarkson et al.
2011/0000684 A1 1/2011 Charles et al.
2011/0042069 A1 2/2011 Bailey et al.
2011/0088953 A1 4/2011 Rainey et al.
2011/0168408 A1 7/2011 Watson
2011/0220415 A1 9/2011 Jin et al.
2011/0308861 A1 12/2011 Radford
2012/0205122 A1 8/2012 Peter et al.

FOREIGN PATENT DOCUMENTS

WO 9904130 1/1999
WO 0131197 5/2001

(56) References Cited

FOREIGN PATENT DOCUMENTS

| | | |
|---|---|---|
| WO | 2008112332 | 9/2008 |
| WO | 2009009281 | 1/2009 |

OTHER PUBLICATIONS

Thomas, Shane, International Search Report and Written Opinion of the International Searching Authority for PCT/US2015/065435, Jan. 21, 2015, pp. 1-10.
Young, Lee W., International Search Report and Written Opinion of the International Searching Authority for PCT/US2014/065428, Jan. 15, 2015, pp. 1-8.
Young, Lee W., International Search Report and Written Opinion of the International Searching Authority for PCT/US2014/065424, Jan. 15, 2015, pp. 1-10.

* cited by examiner

FIELD REMOVABLE CHOKE FOR MOUNTING IN THE PISTON OF A ROTARY PERCUSSION TOOL

RELATED APPLICATIONS

The present application is a continuation-in-part of and claims priority to U.S. patent application Ser. No. 14/079,342, entitled "Top Mounted Choke For Percussion Tool" and filed on Nov. 13, 2013, which is hereby incorporated herein by reference.

The present application is also related to U.S. patent application Ser. No. 14/079,323, entitled "Double Wall Flow Tube For Percussion Tool" and filed on Nov. 13, 2013, which is hereby incorporated by reference herein.

TECHNICAL FIELD

This invention relates generally to percussion tools used in downhole drilling. More particularly, this invention relates to a field removable choke for a piston, where the field removable choke can be replaced without removing the piston from a percussion tool, such as a rotary percussion tool, used in downhole drilling.

BACKGROUND

Rotary drilling tools, such as rock bits, can benefit from percussive energy to improve drilling rate, or rate of penetration (ROP), and improve hole straightness. However, this percussive energy should be controlled. If the percussive energy is too little, the drilling tool will not create and/or propagate fractures in the rock. If the percussive energy is too much, the drilling tool life is unacceptably reduced due to bearing spalling, steel fatigue cracking, and/or other life reducing causes. Hence, to be an effective tool, the drilling tool should be efficient with low drill system pressure, but also should be able to limit percussive force at high drill system pressure.

A choke is commonly used to control the amount of air directed to the piston, which generates, or applies, the percussive force. The remaining amount of air that is not used, or not needed, to be directed to the piston flows into a bypass, or piston passageway, which is described in further detail below in conjunction with FIGS. 1A and 1B. In general, chokes having a larger internal diameter, which is less restrictive to the air flow, are used when air volume is high and less air should be directed to the piston or the required percussive force for the intended application is low. Thus, the excessive air that is not used flows through the choke via this larger internal diameter. Conversely, chokes having a smaller internal diameter, which is more restrictive to the air flow, are used when air volume is small and more air should be directed to the piston or the required percussive force for the intended application is high. Again, any excessive air that is not used flows through the choke via this smaller internal diameter.

The location and positioning of the choke is determined by the design of the percussion tool's internal air flow paths. Generally, this location for the choke is deep inside the percussion tool and not readily accessible without disassembly of the percussion tool. Further, the choke is generally press fit into the top of the piston, requiring an operator to disassemble the percussion tool and bodily remove the piston from the percussion tool in order to change the choke. The disassembly of the percussion tool is cumbersome and time intensive, resulting in excessive lost drilling time and increased operational costs. Disassembly also poses the risk of introducing contaminants into the percussion tool and can expose the operator to more risk for injury.

Percussion tool disassembly generally requires heavy breakout equipment and cannot easily be performed at a drill site. Typically, the percussion tool is disassembled from the drill string or other downhole tool, sent to a shop, and further disassembled to gain access to the choke. The choke may need maintenance due to blockage or due to needing to change out the choke with a different internal diameter choke, for example. There is a need to develop a percussion tool with a choke which can be quickly replaced and/or adjusted without disassembly of the percussion tool. There is also a need to develop a choke that can be quickly replaced and/or adjusted without disassembly of the percussion tool.

FIG. 1A is a longitudinal cross-sectional view of a portion of a conventional downhole percussion tool 10 in accordance with the prior art. FIG. 1B is a longitudinal cross-sectional view of a remaining portion of the conventional downhole percussion tool 10 of FIG. 1A whereby FIG. 1A is intended to be joined to FIG. 1B along common line a-a in accordance with the prior art. The conventional downhole percussion tool 10 is described in detail in U.S. Pat. No. 7,377,338, which issued to Bassinger on May 27, 2008, and is incorporated by reference herein in its entirety. Thus, the conventional downhole percussion tool 10 is briefly described herein for the sake of describing airflow therein and the positioning of the choke 74, or orifice plug. Referring to FIGS. 1A and 1B, the conventional downhole percussion tool 10 includes a tool cylinder or housing 12, a rear adapter or sub 24, a check valve 36, a piston 44, a drive sub 106, and an integrated claw bit 92. Although an integrated claw bit is illustrated within FIG. 1B, a bit sub (not shown) capable of receiving a claw bit, or other bit type such as a rotary or fixed cutter bit, can be used in lieu of the integrated claw bit 92. Once the conventional downhole percussion tool 10 is assembled, a top pressure fluid chamber 78, an annular chamber 97, and a bottom pressure fluid chamber 88 are formed.

The sub 24 includes a sub passage 30 extending longitudinally therein. The check valve 36 is coupled at an end of the sub passage 30 and is positioned within the housing 12 once the sub 24 is threadedly coupled to an end of the housing 12. The check valve 36 allows for pressurized fluid to flow from the sub passage 30 into the housing 12; however, the check valve 36 prevents pressurized fluid from flowing from the housing 12 to the sub passage 30.

Similarly, the drive sub 106 is threadedly coupled to an opposing end of the housing 12. The integrated claw bit 92 is movably coupled within the drive sub 106 at the opposing end of the housing 12. The integrated claw bit 92 includes a bit passage 118 extending longitudinally therein and is in communication with one or more secondary bit passages 120, which are in communication with an environment external to the bit 92. The integrated claw bit 92 is capable of moving in at least an axial direction and may be capable of moving in a rotational manner as well. When the integrated claw bit 92 is in contact with the bottom of the formation or when there is a significant upward force acting upon the integrated claw bit 92, the integrated claw bit 92 is in the dash-lined position as shown in FIG. 1B. Conversely, when the integrated claw bit 92 is not in contact with the bottom of the formation or there is no significant upward force acting upon the integrated claw bit 92, the integrated claw bit 92 is in the solid-lined position as shown in FIG. 1B.

The piston 44 is a single-walled tube that includes a piston passage 70 extending substantially centrally therethrough. An orifice plug 74, or choke valve, is positioned within the piston passage 70 at a top end of the piston 44. The piston passage 70 is in fluid communication with piston base passage 72 formed within an opposing end of the piston 44. The piston 44 also includes at least two pressurized fluid inlet ports 82 formed along a top portion of a sidewall of the piston 44 and extending into an interior of the piston 44. The piston 44 further includes pressurized fluid conducting piston passageways 80 extending from the pressurized fluid inlet ports 82 to the opposing end of the piston 44. Piston 44 further includes one or more exhaust passages 96 that extend from the piston base passage 72 to the annular chamber 97 formed between the piston 44 and the housing 12. The exhaust passages 96 are offset from the pressurized fluid conducting piston passageways 80. The piston 44 is movably positioned within the housing 12. Once the piston 44 is properly assembled within the housing 12, the top pressure fluid chamber 78, the annular chamber 97, and the bottom pressure fluid chamber 88 are formed. The top pressure fluid chamber 78 is formed between the one end of the piston 44 having the orifice plug 74 and the check valve 36. The annular chamber 97 is formed between a portion of the perimeter of the piston 44 and the housing 12. The bottom pressure fluid chamber 88 is formed between the opposing end of the piston 44 and the integrated claw bit 92.

During operation of the conventional downhole percussion tool 10, the tool 10 is placed in a position such that the bit 92 is urged upwardly to the position indicated by the dashed lines in FIG. 1B and the piston 44 will be urged to the position shown by the solid lines in FIGS. 1A and 1B. In this position, the flow of high pressure fluid from top pressure fluid chamber 78 to annular chamber 97 is terminated since a reduced diameter portion 56 of the piston 44 is in close fitting relationship with a sleeve 62 positioned within the housing 12 and about the perimeter of a portion of the piston 44. In this condition, pressure fluid is still communicated through pressurized fluid conducting piston passageways 80 to bottom pressure fluid chamber 88 while pressure fluid is vented from annular chamber 97 through exhaust passages 96 to the exterior of the tool 10 by way of the bit passage 118 and secondary bit passages 120. Thus, a resultant force is exerted on the piston 44 driving it upwardly, viewing FIGS. 1A and 1B, until the reduced diameter portion 56*a* of the piston 44 is positioned such that the communication of high pressure fluid to pressurized fluid inlet ports 82, pressurized fluid conducting piston passageways 80, and bottom pressure fluid chamber 88 is cut-off. A resultant pressure fluid force acting on piston 44 will continue to drive the piston 44 upwardly, viewing FIGS. 1A and 1B, until the pressure fluid from bottom pressure fluid chamber 88 is able to vent through bit passage 118 and secondary bit passages 120. This occurs when the bottom of the piston 44 is raised elevationally above the top of a tube 124, which is positioned at least partially within bit passage 118 and extends outwardly from the top of the bit 92. In this condition, a net resultant pressure fluid force acting on the top surface of the piston 44 is sufficient to drive the piston 44 downwardly to deliver an impact blow to the top surface of the bit 92 and the cycle just described will then repeat itself rapidly and in accordance with the design parameters of the tool 10.

As seen in FIGS. 1A and 1B along with the description provided, it can be seen that the choke valve 74 is coupled to the movable piston 44 and is positioned at the top end of the piston passage 70. Further, the check valve 36 is positioned upstream of the choke valve 74 and is coupled to at the end of the sub passage 30. Once the tool 10 is decoupled from the drill string or other downhole tool, an operator is prevented from accessing the choke valve 74 through the sub passage 30 since the check valve blocks access to the choke valve 74. Hence, the tool 10 must be disassembled for an operator to service the choke valve 74 and/or replace the choke valve 74, which results in increased costs and increased time delay in drilling the hole.

BRIEF DESCRIPTION OF THE DRAWINGS

The foregoing and other features and aspects of the invention will be best understood with reference to the following description of certain exemplary embodiments of the invention, when read in conjunction with the accompanying drawings, wherein:

FIG. 1A is intended to be joined to FIG. 1B along common line a-a in accordance with the prior art;

FIGS. 4A-4J-2 are cross-sectional views of the percussion tool of FIG. 3 without the bit illustrating the operation of the percussion tool in accordance with an exemplary embodiment of the present invention;

The drawings illustrate only exemplary embodiments of the invention and are therefore not to be considered limiting of its scope, as the invention may admit to other equally effective embodiments.

DETAILED DESCRIPTION OF THE INVENTION

This invention relates generally to percussion tools used in downhole drilling. More particularly, this invention relates to an apparatus and method for controlling air flow within percussion tools, such as rotary bits, shear bits, and lighter hammer bits, used in downhole drilling. This invention also relates to a field removable choke for a piston, where the field removable choke can be replaced without removing the piston from a percussion tool, such as a rotary percussion tool, used in downhole drilling.

Although the description provided below is related to a percussion tool with a rotary bit, exemplary embodiments of the invention relate to any downhole percussion tool including, but not limited to, percussion tools having a shear bit, a lighter hammer bit, or other known bit used in percussion tools.

Figure 2:
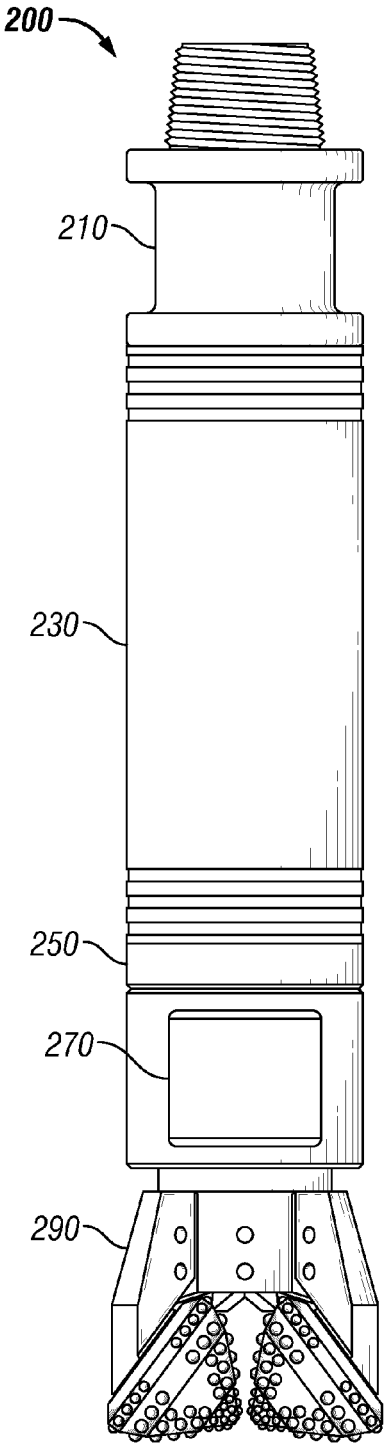
FIG. 2 is a side view of a percussion tool in accordance with an exemplary embodiment of the present invention.
Figure 3:
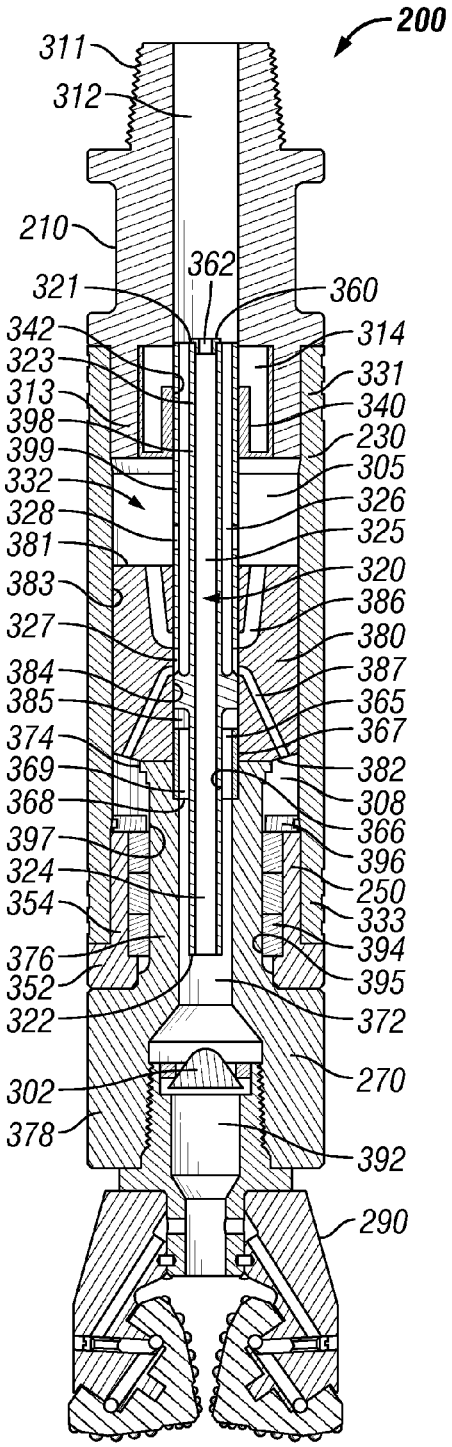
FIG. 3 is a cross-sectional view of the percussion tool of FIG. 2 in accordance with an exemplary embodiment of the present invention.

FIG. 2 is a side view of a percussion tool 200 in accordance with an exemplary embodiment of the present invention. FIG. 3 is a cross-sectional view of the percussion tool 200 in accordance with an exemplary embodiment of the present invention. Referring to FIGS. 2 and 3, the percussion tool 200 includes a top sub 210, a case 230, a drive sub 250, a mandrel 270, and a bit 290, which are viewable and accessible from exterior of the percussion tool 200. The percussion tool 200 further includes a feed tube 320, a feed tube mount 340, a choke 360, a piston 380, one or more drive lugs 394, an exhauster 365, a split retaining ring 396, and a check valve 302, which are all positioned internally of the percussion tool 200. Although certain components have been mentioned, greater or fewer components may be included in the percussion tool 200 without departing from the scope and spirit of the exemplary embodiment. Further, one or more components may be combined or separated from another mentioned component without departing from the scope and spirit of the exemplary embodiment. Once the percussion tool 200 is assembled, a top pressure fluid chamber 305 and a bottom pressure fluid chamber 308 are formed.

The top sub 210 includes a top end 311, a bottom end 313, a sub passage 312 extending longitudinally therein from the top end 311 towards the bottom end 313, and a secondary sub passage 314 extending from the end of the sub passage 312 to the bottom end 313. The top end 311 is threaded and is coupleable to a drill string (not shown) or some other down hole tool according to certain exemplary embodiments. Similarly, the bottom end 313 also is threaded and is coupled to the case 230 according to certain exemplary embodiments. The secondary sub passage 314 is in fluid communication with the sub passage 312. The secondary sub passage 314 is larger in diameter than the sub passage 312 according to some exemplary embodiments. The secondary sub passage 314 houses a portion of the feed tube 320, at least a portion of the feed tube mount 340, and the choke 360 depending upon the length and positioning of the feed tube 320 according to certain exemplary embodiments. In certain other exemplary embodiments, the choke 360 is housed within the sub passage 312 or a combination of the sub passage 312 and the secondary sub passage 314 according to certain exemplary embodiments. Although not illustrated in this exemplary embodiment, the check valve 302 is optionally coupled to the top sub 210 either within the sub passage 312 or within the secondary sub passage 314 above the choke 360 and prevents the upward flow of pressurized fluid, such as air, from the top pressure fluid chamber 305 and/or the feed tube 320 to the drill string or other down hole tool positioned above the top sub 210. This optional exemplary embodiment is illustrated and described with respect to FIGS. 5-7B below. Hence, in this optional exemplary embodiment, the check valve 302 allows for pressurized fluid to flow in the direction from the sub passage 312 to the case 230; however, the check valve 302 prevents pressurized fluid from flowing in the opposite direction. In these exemplary embodiments, the check valve 302 is removable without disassembly of the percussion tool 200 or is able to be locked open, thereby providing access to the choke 360 for replacement or service. In the current exemplary embodiment illustrated in FIG. 3, however, this check valve 230 is positioned within the bit 290, which is described in further detail below. Thus, since the check valve 302 has been repositioned from the positioning in the prior art, access to the choke 360 is available without disassembly of the percussion tool 200.

The case 230 is tubularly shaped and includes a top end 331, a bottom end 333, and a case passageway 332 extending from the top end 331 to the bottom end 333. The case passageway 332 has a variable internal diameter along its length according to certain exemplary embodiments, however, this internal diameter is not variable in other exemplary embodiments. The top end 331 is threaded and is coupled to the bottom end 313 of the top sub 210. Similarly, the bottom end 333 also is threaded and is coupled to the drive sub 250 according to certain exemplary embodiments. The case 230 houses at least a portion of the top sub 210, the feed tube mount 340, the feed tube 320, the piston 380, one or more drive lugs 394, the exhauster 365, the split retaining ring 396, a portion of the drive sub 250, and a portion of the mandrel 270. Once the components of the percussion tool 200 are assembled, the top pressure fluid chamber 305 and the bottom pressure fluid chamber 308 are formed within the case 230.

The drive sub 250 is tubularly shaped and includes a first portion 352 and a second portion 354. The first portion 352 has an outer diameter equal to the outer diameter of the case 230. The second portion 354 extends substantially orthogonally away from the first portion 352 and has an outer diameter less than the outer diameter of the first portion 352 and an inner diameter greater than the inner diameter of the first portion 352. According to certain exemplary embodiments, the second portion 354 is threaded and coupled to the bottom end 333 of the case 230. Once the drive sub 250 is assembled to the case 230, the outer surfaces of both the first portion 352 of the drive sub 250 and the case 230 are substantially aligned. The drive sub 250 houses the one or more drive lugs 394 and a portion of the mandrel 270 and the feed tube 320 according to certain exemplary embodiments.

The mandrel 270 is a substantially solid component having a mandrel passageway 372 extending axially therethrough. The mandrel passageway 372 houses a portion of the feed tube 320 and is in fluid communication with the sub passage 312 via the feed tube 320, which is described in greater detail below, in accordance with certain exemplary embodiments. The mandrel 270 further includes a top portion 374, a bottom portion 378, and a middle portion 376 extending from the top portion 374 to the bottom portion 378. The middle portion 376 has an outer diameter less than the outer diameters of both the top portion 374 and the bottom portion 378. The bottom portion 378 has an outer diameter equal to the outer diameter of the first portion 352 of the drive sub 250. Further, the top portion 374 has an outer diameter less than the outer diameter of the bottom portion 378 and greater than the outer diameter of the middle portion 376. The mandrel 270 houses a portion of the feed tube 320 and at least a portion of the exhauster 365. Once the mandrel 270 is assembled to form the percussion tool 200, the mandrel 270 is axially moveable with respect to both the case 230 and the drive sub 250 and a portion of the mandrel 270 is inserted and housed within the case 230. The bottom portion 378 of the mandrel 270 is positioned adjacent to the first portion 352 of the drive sub 250 when the bit 290 is placed within the formation in contact with the bottom of the hole and with a downward force applied onto the bottom of the hole. However, the bottom portion 378 of the mandrel 270 is not positioned adjacent to the first portion 352 of the drive sub 250 when the bit 290 is placed within the formation and is not in contact with the bottom of the hole. The mandrel passageway 372 has a larger diameter at the bottom portion 378 of the mandrel 270 and is configured to receive a portion of the bit 290 therein according to certain exemplary embodiments. In certain of these exemplary embodiments, the lower portion of the mandrel passageway 372 is threaded and engages with a portion of the bit 290. However, in alternative exemplary embodiments, the bit 290 and the mandrel 270 are formed as an integral component, such as when the percussion tool includes a hammer bit.

Bit 290 is a roller cone bit that is coupled to the mandrel 270 within the lower portion of the mandrel passageway 372 according to certain exemplary embodiments. The bit 290 is threadedly engaged to the mandrel 270 according to some exemplary embodiments. Although the bit 290 is illustrated as a roller cone bit in certain exemplary embodiments, the bit 290 is a different type of bit, such as a polycrystalline diamond cutter (PDC) bit, or other type of drag bit or fixed cutter bit. Alternatively, in other exemplary embodiments, the bit 290 is integrally formed with the mandrel 270, such as a hammer bit, as a single component. Bit 290 includes a bit passageway 392 extending therein and in fluid communication with the mandrel passageway 372. The bit passageway 392 communicates pressurized fluid, such as air, from the mandrel passageway 372 to an environment external of the bit 290. Further, according to certain exemplary embodiments, the check valve 302 is coupled within the bit passageway 392 of the bit 290. The check valve 302 is designed to allow flow from the mandrel passageway 372 to the environment external to the bit 290; however, the check valve 302 prevents flow in the reverse direction. As previously mentioned, according to some alternative exemplary embodiments as illustrated and described with respect to FIGS. 5-7B, this check valve 302 is positioned upstream, or vertically above, the choke 360 when the check valve 302 is replaceable or is capable of being locked open.

As previously mentioned, the percussion tool 200 further includes the feed tube 320, the feed tube mount 340, the choke 360, the piston 380, one or more drive lugs 394, the exhauster 365, and the split retaining ring 396. According to certain exemplary embodiments, the feed tube 320 is a double-wall feed tube and is tubular in shape. The feed tube 320 includes a top end 321, a bottom end 322, an upper portion 323, and a lower portion 324. The feed tube 320 also includes an inner wall 398 and an outer wall 399. The upper portion 323 extends from the top end 321 towards the bottom end 322 and the lower portion 324 extends from the upper portion 323 to the bottom end 322. According to certain exemplary embodiments, the upper portion 323 has a greater outer diameter than the lower portion 324. The feed tube 320 includes a central feed tube channel 325 extending from the top end 321 to the bottom end 322 and is defined by the inner wall 398. The central feed tube channel 325 communicates pressurized fluid from the sub passage 312 to the mandrel passageway 372. The feed tube 320 also includes an outer feed tube channel 326, which extends from the top end 321 towards the lower portion 324, but remains within the upper portion 323 according to certain exemplary embodiments. The outer feed tube channel 326 is defined by the outer wall 399 and the inner wall 398 and is positioned therebetween. However, in other exemplary embodiments, the outer feed tube channel 326 extends into the lower portion 324 but not through the feed tube 320. The outer feed tube channel 326 circumferentially surrounds a portion of the length of the central feed tube channel 325; however, in other exemplary embodiments, the outer feed tube channel 326 does not circumferentially surround a portion of the central feed tube channel 325. For example, the outer feed tube channel 326 may be a single channel extending from the top end 321 or may be several discrete channels extending from the top end 321. Additionally, the feed tube 320 includes one or more first openings 327 and one or more second openings 328 positioned about the perimeter of the upper portion 323 through the outer wall 399. However, in other exemplary embodiments, some or all of these openings 327, 328 are positioned about the perimeter of the lower portion 324 when the outer feed tube channel 326 extends into the lower portion 324. The first openings 327 communicate pressurized fluid from within the outer feed tube channel 326 to the bottom pressure fluid chamber 308 through an interior of the piston 380, while the second openings 328 communicate pressurized fluid from within the outer feed tube channel 326 to the top pressure fluid chamber 305 via the interior of the piston 380. According to some exemplary embodiments, the first openings 327 are radially aligned with one another at substantially the same elevation; however, in other exemplary embodiments, one or more first openings 327 are not radially aligned with one another at the same elevation. Similarly, according to some exemplary embodiments, the second openings 328 are radially aligned with one another at substantially the same elevation; however, in other exemplary embodiments, one or more second openings 328 are not radially aligned with one another at the same elevation. Yet, in other exemplary alternative exemplary embodiments, there are only one or more first openings 327 and no second openings 328 as the first openings are configured to convey pressurized fluid either to the bottom pressure fluid chamber 308 or to the top pressure fluid chamber 305 depending upon the elevational positioning of the piston 380. In other exemplary embodiments, the first openings 327 communicate pressurized fluid from within the outer feed tube channel 326 to the top pressure fluid chamber 305 through an interior of the piston 380, while the second openings 328 communicate pressurized fluid from within the outer feed tube channel 326 to the bottom pressure fluid chamber 308 via the interior of the piston 380.

The feed tube 320 extends from within a portion of the top sub 210 to within a portion of the mandrel 270 and facilitates the communication of pressurized fluid from the sub passage 312 of the top sub 210 to the mandrel passageway 372 of the mandrel 270 and also facilitates the communication of pressurized fluid from the sub passage 312 of the top sub 210 to either to the bottom pressure fluid chamber 308 or to the top pressure fluid chamber 305 depending upon the elevational positioning of the piston 380. According to some exemplary embodiments, the top end 321 of the feed tube 320 extends into the sub passage 312. According to some exemplary embodiments, the outer diameters of the top end 321 of the feed tube 320 and the sub passage 312 are substantially the same such that the top end 321 frictionally fits within the sub passage 312. The feed tube 320 is surrounded by a portion of the top sub 210, the casing 230, a portion of the drive sub 250, a portion of the mandrel 270, the feed tube mount 340, the piston 380, the one or more drive lugs 394, the exhauster 365, and the split retaining ring 396. According to certain exemplary embodiments, the feed tube 320 is fixedly coupled within the interior of the percussion tool 200 using at least one of the feed tube mount 340 and/or the exhauster 365. For example, in one or more exemplary embodiments, the feed tube 320 frictionally fits within the feed tube mount 340 and/or the exhauster 365.

The feed tube mount 340 is annularly shaped with a feed tube mount passageway 342 extending longitudinally therethrough according to certain exemplary embodiments. The feed tube mount 340 is positioned within the secondary sub passage 314 according to some exemplary embodiments, but can be positioned elsewhere, such as within the top pressure fluid chamber 305 in other exemplary embodiments. The feed tube mount passageway 342 receives at least a portion of the feed tube 320 and may assist in mounting the feed tube 320 within the percussion tool 200. According to certain exemplary embodiments, the feed tube 320 extends entirely through the feed tube mount 340. However, according to some exemplary embodiments, the feed tube 320 is a single-walled feed tube or is omitted as the function of the feed tube is carried out as described in the prior art.

The choke 360 also is annularly shaped and forms a plug that fits into the central feed tube channel 325 at the top end 321 of the feed tube 320. The choke 360 includes a choke passageway 362 formed longitudinally therethrough. The dimension, or diameter, of this choke passageway 362 limits the amount of pressurized fluid flowing into the central feed tube channel 325 from the sub passage 312. The pressurized fluid generally flows from the sub passage 312 into the outer feed tube channel 326 and then into either the bottom pressure fluid chamber 308 or to the top pressure fluid chamber 305 depending upon the elevational positioning of the piston 380. However, the excess pressurized fluid flows into the central feed tube channel 325 through the choke 360. The choke 360 is replaceable depending upon the desired restriction, which determines the amount of pressurized fluid that flows into the central feed tube channel 325 through the choke 360. For example, less pressurized fluid flows into the central feed tube channel 325 through the choke 360 when the dimension, or diameter, of the choke passageway 362 is small when compared to when the dimension, or diameter, of the choke passageway 362 is larger. The replacement of the choke 360 is fairly simple and does not require several components of the percussion tool 200 to be dismantled considering that the check valve 302 has been relocated to downstream of the choke 360 according to some of the exemplary embodiments. The top sub 210, along with the remaining components of the percussion tool 200 positioned below the top sub 210, is threadedly removed, or disengaged, from the drill string, or other down hole tool, that it is coupled to. Once the top sub 210 is disengaged, an operator is able to remove the choke 360 by accessing it through the sub passage 312 from the top end 311. Once the operator removes the choke 360, the operator is able to install a different choke of a different size, or the same size if choke 360 has been damaged, depending upon the operating requirements through the same sub passage 312 from the top end 311. Once the choke 360 has been replaced, the top sub 210, along with the remaining attached components, are threadedly coupled, or re-engaged, to the drill string, or other down hole tool, that it is to be coupled to. Alternatively, if the check valve 302 remained in the position as shown in the prior art, i.e. upstream of the choke, the check valve 302 would need to be locked open or removable without dismantling of the percussion tool 200, thereby allowing repair or replacement of the choke also without dismantling of the percussion tool 200. This is illustrated and described with respect to FIGS. 5-7B below.

Piston 380 is annularly shaped and includes a top end 381, a bottom end 382, an exterior surface 383, and an interior surface 384 that defines a piston passageway 385 extending longitudinally through the piston 380. The piston 380 further includes at least one first pressurized fluid conduit 386 that extends from the interior surface 384 to the top end 381 and at least one second pressurized fluid conduit 387 that extends from the interior surface 384 to the bottom end 382. Further, the piston 380 includes at least one top exhaust conduit 430 (FIG. 4B-2) that extends from the top end 381 to a lower portion of the interior surface 384 such that the top exhaust conduit 430 (FIG. 4B-2) can communicate pressurized fluid from the top pressure fluid chamber 305 to the exhauster 365 when the at least one second pressurized fluid conduit 387 communicates pressurized fluid to the bottom pressure fluid chamber 308. The piston 380 is positioned within the case passageway 332 such that the interior surface 384 is positioned slidably and in contact with the feed tube 320 and the exterior surface 383 is positioned slidably and in contact with the casing 230. Once the piston 380 is slidably positioned within the case passageway 332, the top pressure fluid chamber 305 is formed within the case passageway 332 adjacently above the top end 381 and the bottom pressure fluid chamber 308 is formed within the case passageway 332 adjacently below the bottom end 382. As the piston slidably moves upward towards the top sub 210, the volume of the top pressure fluid chamber 305 decreases while the volume of the bottom pressure fluid chamber 308 increases. Conversely, as the piston 380 slidably moves downward towards the mandrel 270, the volume of the top pressure fluid chamber 305 increases while the volume of the bottom pressure fluid chamber 308 decreases. The piston 380 is used to deliver a downward force onto the mandrel 270 when the bottom end 382 makes downward contact with the mandrel 270. The piston 380 is forced back up and then cycles down again to make contact with the mandrel 270. This cycling of the piston 380 continues until the flow of pressurized fluid through the outer feed tube channel 326 is stopped. The details of this piston 380 operation is provided below in conjunction with FIGS. 4A-J in accordance with one or more exemplary embodiments.

One or more drive lugs 394 are annularly shaped, stacked on top of one another, and positioned between and in contact with the second portion 354 of the drive sub 250 and the middle portion 376 of the mandrel 270. Each drive lug 394 includes a drive lug passageway 395 that extends longitudinally therethrough and receives a portion of the mandrel 270 therein. Specifically, once the drive lugs 394 and the mandrel 270 are properly installed, the middle portion 376 of the mandrel 270 slidably engages with the one or more drive lugs 394 through the drive lug passageway 395. When an upward force is placed onto the bottom of the bit 290, the mandrel 270 slidably moves toward the top sub 210 such that the bottom portion 378 of the mandrel 270 and the drive sub 250 are adjacent and/or in contact with one another. Conversely, when an upward force is not placed onto the bottom of the bit 290, the mandrel 270 slidably moves away the top sub 210 such that the bottom portion 378 of the mandrel 270 and the drive sub 250 are not adjacent and/or not in contact with one another. According to the exemplary embodiment, three drive lugs 394 are shown; however, greater or fewer drive lugs 394 are used in other exemplary embodiments.

The split retaining ring 396 also is annularly shaped, stacked on top of one of the drive lugs 394 and the second portion 354 of the drive sub 250, and positioned between and in contact with the lower portion of the case 230 and the middle portion 376 of the mandrel 270 The split retaining ring 396 includes a split retaining ring passageway 397 that extends longitudinally therethrough and receives a portion of the mandrel 270 therein. Specifically, once the split retaining ring 396 and the mandrel 270 are properly installed, the middle portion 376 of the mandrel 270 slidably engages with the split retaining ring 396 through the split retaining ring passageway 397. When an upward force is placed onto the bottom of the bit 290, the mandrel 270 slidably moves toward the top sub 210 such that the top portion 374 of the mandrel 270 and the split retaining ring 396 are not adjacent and/or in contact with one another. Conversely, when an upward force is not placed onto the bottom of the bit 290, the mandrel 270 slidably moves away the top sub 210 such that the top portion 374 of the mandrel 270 and the split retaining ring 396 are adjacent and/or in contact with one another. The split retaining ring 396 prevents the mandrel 270 and the bit 290 from disengaging from the remaining components of the percussion tool 200, such as the casing 230. According to the exemplary embodiment, a single split retaining ring 396 is shown; however, greater number of split retaining rings 396 are used in other exemplary embodiments.

The exhauster 365 also is annularly shaped and is doubled-walled in accordance with some exemplary embodiments. The exhauster 365 includes an inner wall 366 and an outer wall 367. The inner wall 366 is tubularly shaped and defines an exhauster inner passageway 368 that extends longitudinally therethrough. The exhauster inner passageway 368 receives a portion of the lower portion 324 of the feed tube 320, which extends through the entire exhauster inner passageway 368. According to certain exemplary embodiments, the inner wall 366 provide some support to the feed tube 320. The outer wall 367 also is tubularly shaped and surrounds the inner wall 366. The outer wall 367 and the inner wall 366 collectively define an exhauster outer passageway 369 that extends longitudinally through the exhauster 365. The exhauster outer passageway 369 provides a pathway to exhaust pressurized fluid from the top fluid pressure chamber 305, through the piston 380, and into mandrel passageway 372 so that the pressurized fluid may exit to the external environment as the piston 380 moves upwardly towards the top sub 210. The exhauster 365 is positioned around a portion of the feed tube 320 and located between the feed tube 320 and a portion of the mandrel 270 and a portion of the piston 380 when the piston 380 is at its lower position. When the piston moves to its lower position, i.e. towards the mandrel 270, a portion of the exhauster 365 slides into the piston passageway 385, thereby preventing the exhaust of pressurized fluid from the bottom fluid pressure chamber 308.

Figures 2, 4B:
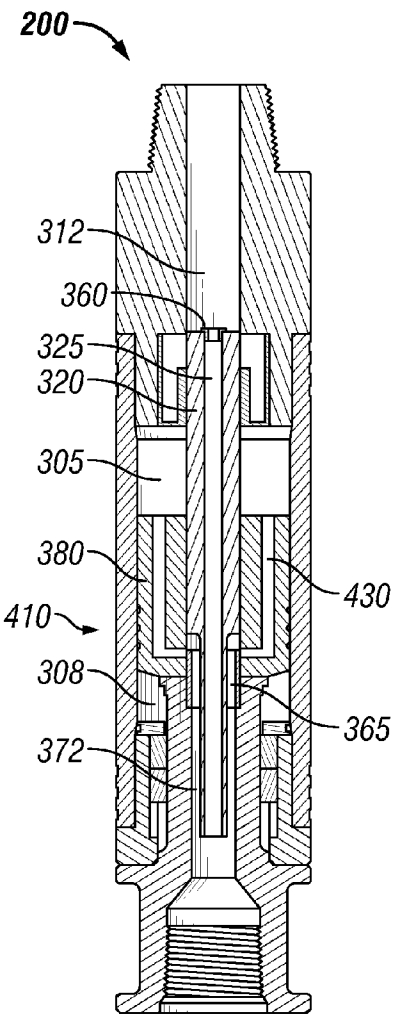
Figures 1, 4B:
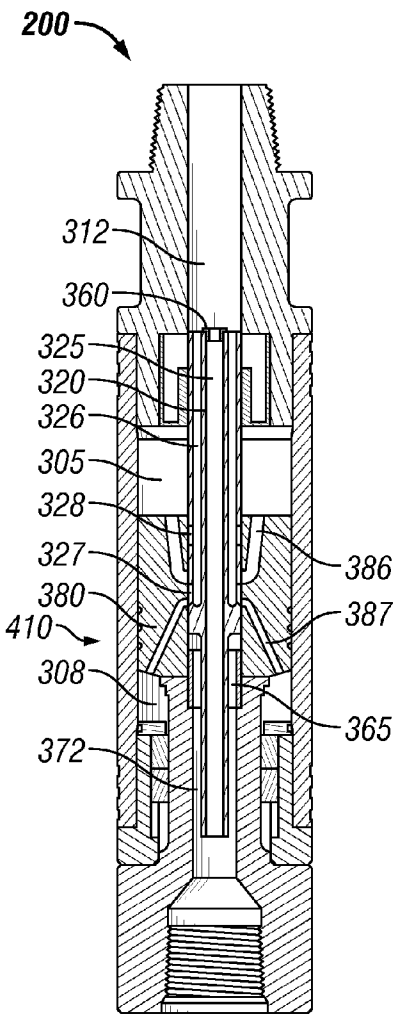
Figure 4A:
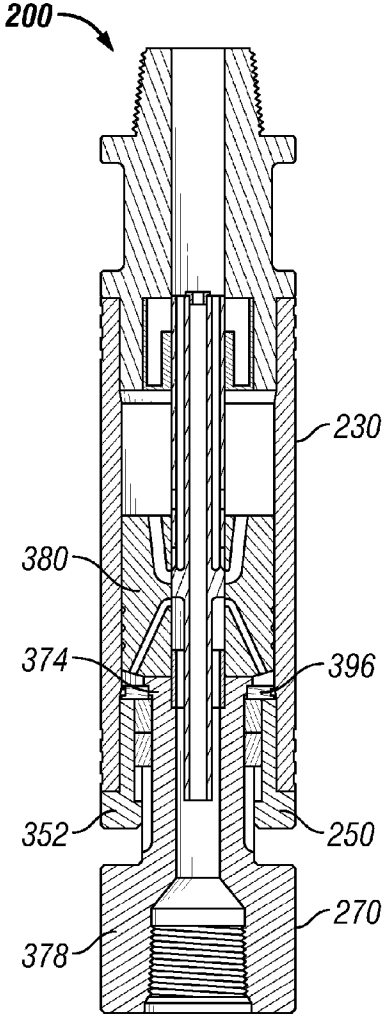

FIGS. 4A-4J-2 are cross-sectional views of the percussion tool 200 without the bit 290 (FIG. 2) illustrating the operation of the percussion tool 200 in accordance with an exemplary embodiment of the present invention. Specifically, FIG. 4A is a cross-sectional view of the percussion tool 200 when no upward force is exerted on the mandrel 270 in accordance with an exemplary embodiment of the present invention. Referring to FIG. 4A and as previously mentioned, the bottom portion 378 of the mandrel 270 is not positioned adjacent to the first portion 352 of the drive sub 250 when the bit 290 (FIG. 2) is placed within the formation and is not in contact with the bottom of the hole, for example, when an upward force is not exerted on the mandrel 270. Further, the top portion 374 of the mandrel 270 is in contact with the split retaining ring 396 and is prevented from being disengaged from the remaining components of the percussion tool 200. Hence, the mandrel 270 remains housed within at least a portion of the casing 230. Additionally, the piston 380 is positioned adjacently and in contact with the top portion 374 of the mandrel 270. However, once an upward force is exerted on the bottom of the mandrel 270, such as when the bit 290 (FIG. 2) is in contact with the bottom of the hole during drilling and as shown in each of FIGS. 4B-1-4J-2, the bottom portion 378 of the mandrel 270 is positioned adjacently and in contact with the first portion 352 of the drive sub 250.

For convenience purposes, it is assumed that an upward force is exerted on the bottom of the mandrel 270 in each of FIGS. 4B-1-4J-2 and therefore is not reiterated in the descriptions for each of those figures. Further, the non-illustration of the bit 290 (FIG. 2) in each of FIGS. 4B-1-4J-2 is not reiterated in the description for each of those figures. Either a bit, such as bit 290 (FIG. 2) is coupled to the mandrel 270 or an integrated bit, such as a hammer, is formed with the mandrel 270.

FIG. 4B-1 is a cross-sectional view of the percussion tool 200 with the piston 380 in the down position 410 and showing the positioning of the at least one first pressurized fluid conduit 386 and the at least one second pressurized fluid conduit 387 in accordance with an exemplary embodiment of the present invention. FIG. 4B-2 is a cross-sectional view of the percussion tool 200 with the piston 380 in the down position 410 and showing the positioning of the at least one top exhaust conduit 430 in accordance with an exemplary embodiment of the present invention. Referring to FIGS. 4B-1 and 4B-2, the piston 380 is positioned in the down position 410 and facilitates forming the top pressure fluid chamber 305 above it and the bottom pressure fluid chamber 308 below it, where the bottom pressure fluid chamber 308 is smaller in volume than the top pressure fluid chamber 305. At this down position 410, the second pressurized fluid conduits 387 within the piston 380 are in fluid communication with at least one respective first opening 327 of the feed tube 320 and hence is able to communicate pressurize fluid from the outer feed tube channel 326 to the bottom pressure fluid chamber 308. However, at this down position 410, the first pressurized fluid conduits 386 within the piston 380 are not in fluid communication with any of the second openings 328 of the feed tube 320 and hence is not able to communicate pressurize fluid from the outer feed tube channel 326 to the top pressure fluid chamber 305. Thus, only the bottom pressure fluid chamber 308 is filled with pressurized fluid while the top pressure fluid chamber 305 is not, when the piston 380 is at this down position 410. As the bottom pressure fluid chamber 308 is filled and the pressure therein increases, the piston 380 commences rising, thereby decreasing the volume of the top pressure fluid chamber 305 and increasing the volume of the bottom pressure fluid chamber 308. The pressurized fluid within the bottom pressure fluid chamber 308 does not exhaust through the exhauster 365 when the piston 380 is at this down position 410. As the volume on the top pressure fluid chamber 305 decreases, the fluid therein is exhausted to the outside environment through the at least one top exhaust conduit 430. This fluid proceeds from the top pressure fluid chamber 305, into the at least one top exhaust conduit 430, through the exhauster 365, through the mandrel passageway 372, and out the bit 290 (FIG. 2) through the check valve 302 (FIG. 3), if positioned within the bit 290 (FIG. 2), and the bit passageway 392 (FIG. 3). The excess pressurized fluid flowing from the sub passage 312, which is not used for filling the bottom pressure fluid chamber 308, flows into the central feed tube channel 325 of the feed tube 320 via the choke 360, then through the exhauster 365 into the mandrel passageway 372, and out the bit 290 (FIG. 2) through the check valve 302 (FIG. 3), if positioned within the bit 290 (FIG. 2), and the bit passageway 392 (FIG. 3). As seen, the pressurized fluid enters only the bottom pressure fluid chamber 308 and therefore is not used to counteract, or work against, itself when being used to move the piston 380.

Figures 1, 4C:
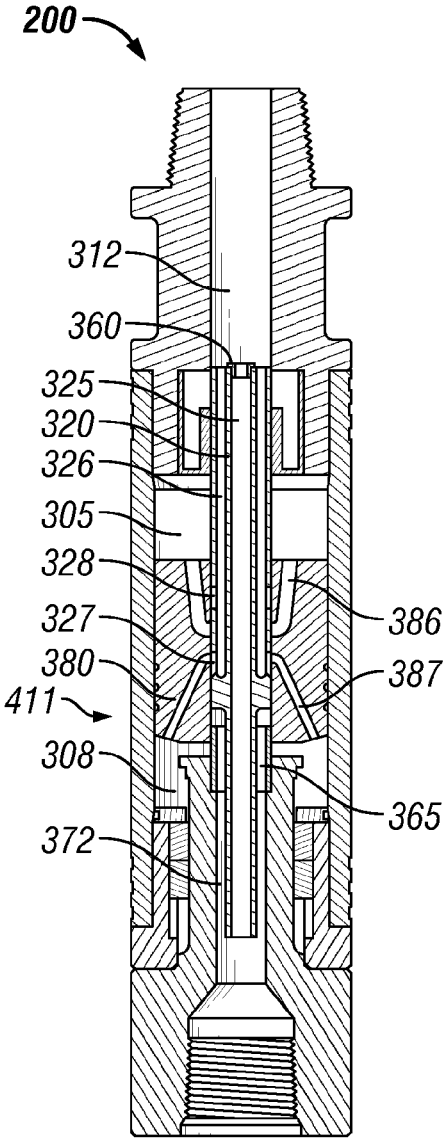
Figures 2, 4C:
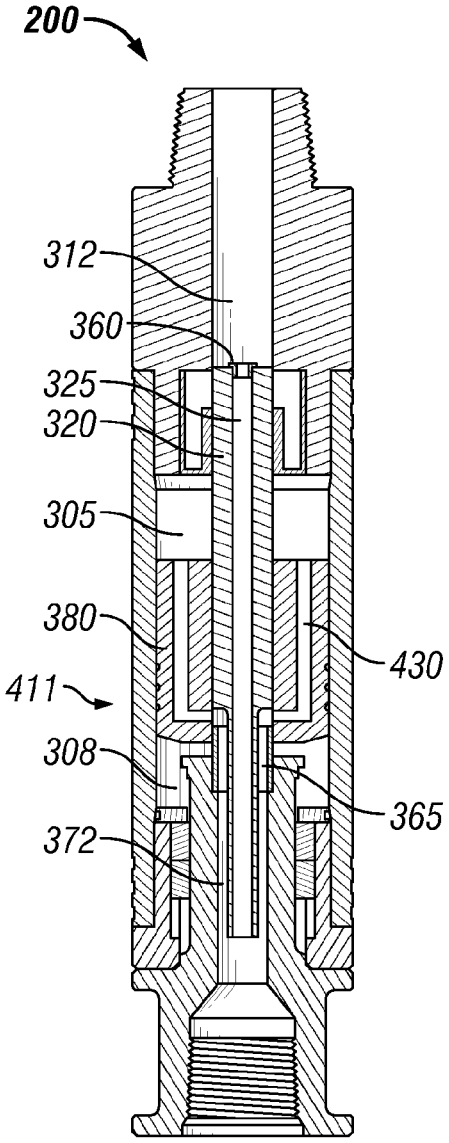

FIG. 4C-1 is a cross-sectional view of the percussion tool 200 with the piston 380 in a first intermediate upward moving position 411 and showing the positioning of the at least one first pressurized fluid conduit 386 and the at least one second pressurized fluid conduit 387 in accordance with an exemplary embodiment of the present invention. FIG. 4C-2 is a cross-sectional view of the percussion tool 200 with the piston 380 in the first intermediate upward moving position 411 and showing the positioning of the at least one top exhaust conduit 430 in accordance with an exemplary embodiment of the present invention. Referring to FIGS. 4C-1 and 4C-2, the piston 380 is positioned in the first intermediate upward moving position 411 and facilitates forming the top pressure fluid chamber 305 above it and the bottom pressure fluid chamber 308 below it. The bottom pressure fluid chamber 308 has increased in volume and the top pressure fluid chamber 305 has decreased in volume when compared to when the piston 380 was in the down position 410 (FIG. 4B-1). At this first intermediate upward moving position 411, the second pressurized fluid conduits 387 within the piston 380 are still in fluid communication with at least one respective first opening 327 of the feed tube 320 and hence still communicates pressurize fluid from the outer feed tube channel 326 to the bottom pressure fluid chamber 308. However, at this first intermediate upward moving position 411, the first pressurized fluid conduits 386 within the piston 380 are not in fluid communication with any of the second openings 328 of the feed tube 320 and hence is not able to communicate pressurize fluid from the outer feed tube channel 326 to the top pressure fluid chamber 305. Thus, only the bottom pressure fluid chamber 308 is filled with pressurized fluid while the top pressure fluid chamber 305 is not, when the piston 380 is at this first intermediate upward moving position 411. As the bottom pressure fluid chamber 308 continues to be filled and the pressure therein increases, the piston 380 continues rising, thereby further decreasing the volume of the top pressure fluid chamber 305 and further increasing the volume of the bottom pressure fluid chamber 308. The pressurized fluid within the bottom pressure fluid chamber 308 still does not exhaust through the exhauster 365 when the piston 380 is at this first intermediate upward moving position 411. As the volume on the top pressure fluid chamber 305 continues to decrease, the fluid therein continues to be exhausted to the outside environment through the at least one top exhaust conduit 430. This fluid proceeds from the top pressure fluid chamber 305, into the at least one top exhaust conduit 430, through the exhauster 365, through the mandrel passageway 372, and out the bit 290 (FIG. 2) through the check valve 302 (FIG. 3), if positioned within the bit 290 (FIG. 2), and the bit passageway 392 (FIG. 3). The excess pressurized fluid flowing from the sub passage 312, which is not used for filling the bottom pressure fluid chamber 308, flows into the central feed tube channel 325 of the feed tube 320 via the choke 360, then through the exhauster 365 into the mandrel passageway 372, and out the bit 290 (FIG. 2) through the check valve 302 (FIG. 3), if positioned within the bit 290 (FIG. 2), and the bit passageway 392 (FIG. 3). As seen, the pressurized fluid still enters only the bottom pressure fluid chamber 308 and therefore is not used to counteract, or work against, itself when being used to move the piston 380.

Figures 1, 4D:
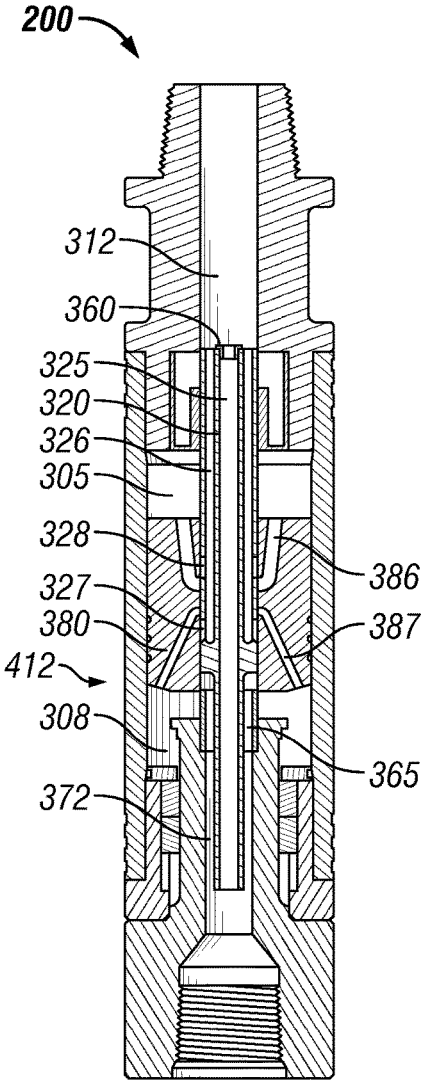
Figures 2, 4D:
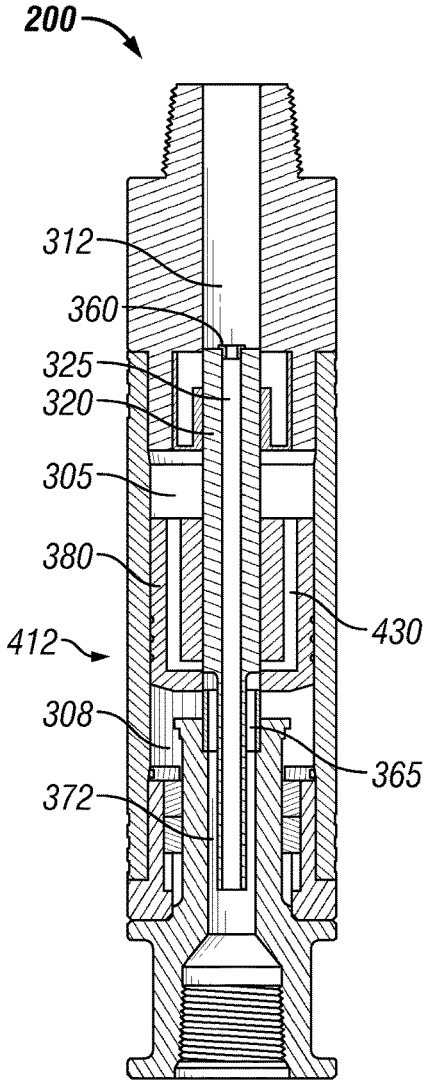

FIG. 4D-1 is a cross-sectional view of the percussion tool 200 with the piston 380 in a second intermediate upward moving position 412 and showing the positioning of the at least one first pressurized fluid conduit 386 and the at least one second pressurized fluid conduit 387 in accordance with an exemplary embodiment of the present invention. FIG. 4D-2 is a cross-sectional view of the percussion tool 200 with the piston 380 in the second intermediate upward moving position 412 and showing the positioning of the at least one top exhaust conduit 430 in accordance with an exemplary embodiment of the present invention. Referring to FIGS. 4D-1 and 4D-2, the piston 380 is positioned in the second intermediate upward moving position 412 and facilitates forming the top pressure fluid chamber 305 above it and the bottom pressure fluid chamber 308 below it. The bottom pressure fluid chamber 308 has further increased in volume and the top pressure fluid chamber 305 has further decreased in volume when compared to when the piston 380 was in the first intermediate upward moving position 411 (FIG. 4C-1). At this second intermediate upward moving position 412, the second pressurized fluid conduits 387 within the piston 380 are no longer in fluid communication with the first openings 327 of the feed tube 320 and hence do not communicate pressurized fluid from the outer feed tube channel 326 to the bottom pressure fluid chamber 308. Similarly, at this second intermediate upward moving position 412, the first pressurized fluid conduits 386 within the piston 380 also are not in fluid communication with any of the second openings 328 of the feed tube 320 and hence are not able to communicate pressurized fluid from the outer feed tube channel 326 to the top pressure fluid chamber 305. Thus, neither the bottom pressure fluid chamber 308 nor the top pressure fluid chamber 305 is filled with pressurized fluid, when the piston 380 is at this second intermediate upward moving position 412. However, the piston 380 continues moving in an upward direction from the forces previously applied to the bottom of the piston. Hence, as the piston 380 continues rising, the volume of the top pressure fluid chamber 305 continues to further decrease, while the volume of the bottom pressure fluid chamber 308 continues to further increase. The pressurized fluid within the bottom pressure fluid chamber 308 still does not exhaust through the exhauster 365 when the piston 380 is at this second intermediate upward moving position 412. Similarly, the fluid within the top pressure fluid chamber 305 no longer continues to exhaust through the exhauster 365 since the top exhaust conduits 430 are not in fluid communication with the exhauster 365. The excess pressurized fluid flowing from the sub passage 312, which is substantially all the pressurized fluid therein, flows into the central feed tube channel 325 of the feed tube 320 via the choke 360, then through the exhauster 365 into the mandrel passageway 372, and out the bit 290 (FIG. 2) through the check valve 302 (FIG. 3), if positioned within the bit 290 (FIG. 2), and the bit passageway 392 (FIG. 3). As seen, the pressurized fluid does not enter any of the bottom pressure fluid chamber 308 or the top pressure fluid chamber 305, and therefore is not used to counteract, or work against, itself when being used to move the piston 380.

Figures 1, 4E:
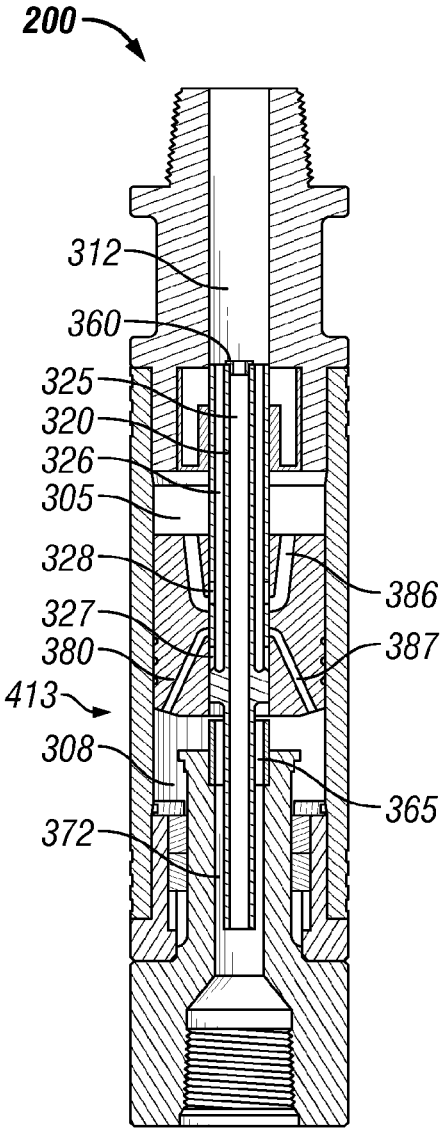
Figures 2, 4E:
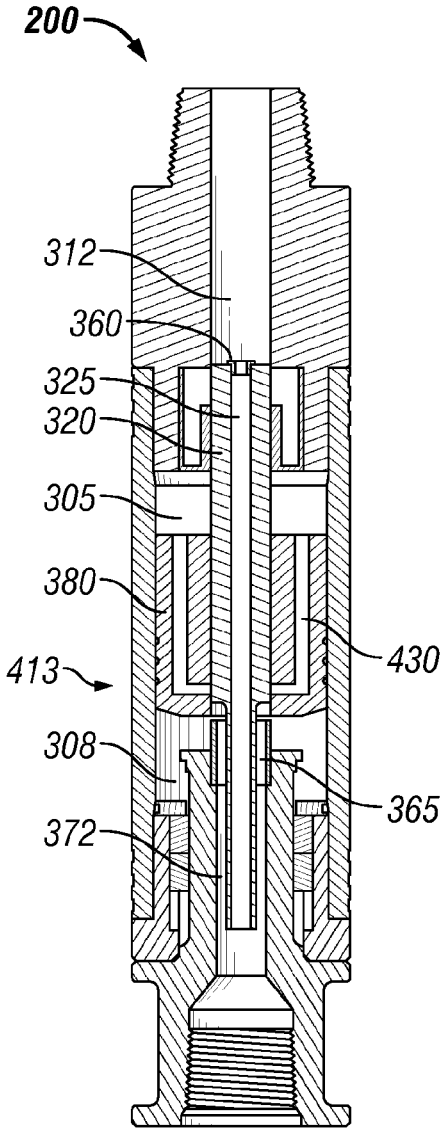

FIG. 4E-1 is a cross-sectional view of the percussion tool 200 with the piston 380 in a third intermediate upward moving position 413 and showing the positioning of the at least one first pressurized fluid conduit 386 and the at least one second pressurized fluid conduit 387 in accordance with an exemplary embodiment of the present invention. FIG. 4E-2 is a cross-sectional view of the percussion tool 200 with the piston 380 in the third intermediate upward moving position 413 and showing the positioning of the at least one top exhaust conduit 430 in accordance with an exemplary embodiment of the present invention. Referring to FIGS. 4E-1 and 4E-2, the piston 380 is positioned in the third intermediate upward moving position 413 and facilitates forming the top pressure fluid chamber 305 above it and the bottom pressure fluid chamber 308 below it. The bottom pressure fluid chamber 308 has increased in volume and the top pressure fluid chamber 305 has decreased in volume when compared to when the piston 380 was in the second intermediate upward moving position 412 (FIG. 4D-1). At this third intermediate upward moving position 413, the first pressurized fluid conduits 386 within the piston 380 are now in fluid communication with at least one respective second opening 328 of the feed tube 320 and hence communicates pressurized fluid from the outer feed tube channel 326 to the top pressure fluid chamber 305. However, at this third intermediate upward moving position 413, the second pressurized fluid conduits 387 within the piston 380 are not in fluid communication with any of the first openings 327 of the feed tube 320 and hence are not able to communicate pressurized fluid from the outer feed tube channel 326 to the bottom pressure fluid chamber 308. Thus, now only the top pressure fluid chamber 305 is filled with pressurized fluid while the bottom pressure fluid chamber 308 is not, when the piston 380 is at this third intermediate upward moving position 413. As the top pressure fluid chamber 305 is now filled with pressurized fluid and the pressure therein increases, the piston 380 continues rising but starts slowing down, thereby further decreasing the volume of the top pressure fluid chamber 305 and further increasing the volume of the bottom pressure fluid chamber 308. The pressurized fluid within the bottom pressure fluid chamber 308 now exhausts through the exhauster 365 when the piston 380 is at this third intermediate upward moving position 413. This fluid proceeds from the bottom pressure fluid chamber 308, through the exhauster 365, through the mandrel passageway 372, and out the bit 290 (FIG. 2) through the check valve 302 (FIG. 3), if positioned within the bit 290 (FIG. 2), and the bit passageway 392 (FIG. 3). As the volume in the top pressure fluid chamber 305 continues to decrease, the fluid therein is pressurized more since the fluid therein is not exhausted through the exhauster 365. The at least one top exhaust conduit 430 is no longer fluidly communicable with the exhauster 365. This pressurized fluid within the top pressure fluid chamber 305 causes the piston 380 to slow down in its upward movement. The excess pressurized fluid flowing from the sub passage 312, which is not used for filling the top pressure fluid chamber 305, flows into the central feed tube channel 325 of the feed tube 320 via the choke 360, then through the exhauster 365 into the mandrel passageway 372, and out the bit 290 (FIG. 2) through the check valve 302 (FIG. 3), if positioned within the bit 290 (FIG. 2), and the bit passageway 392 (FIG. 3). As seen, the pressurized fluid now enters only the top pressure fluid chamber 305 and therefore is not used to counteract, or work against, itself when being used to slow the movement of the piston 380.

Figures 1, 4F:
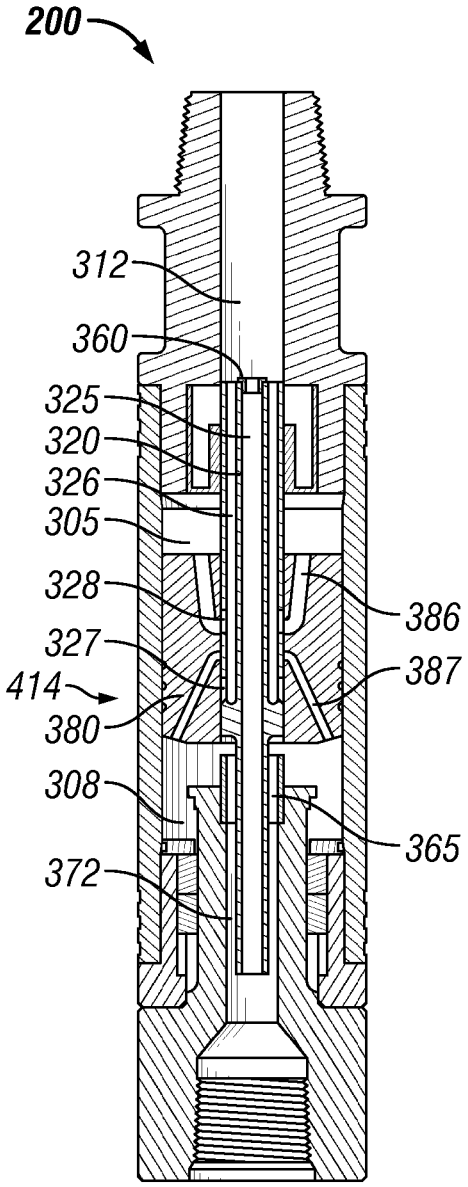
Figures 2, 4F:
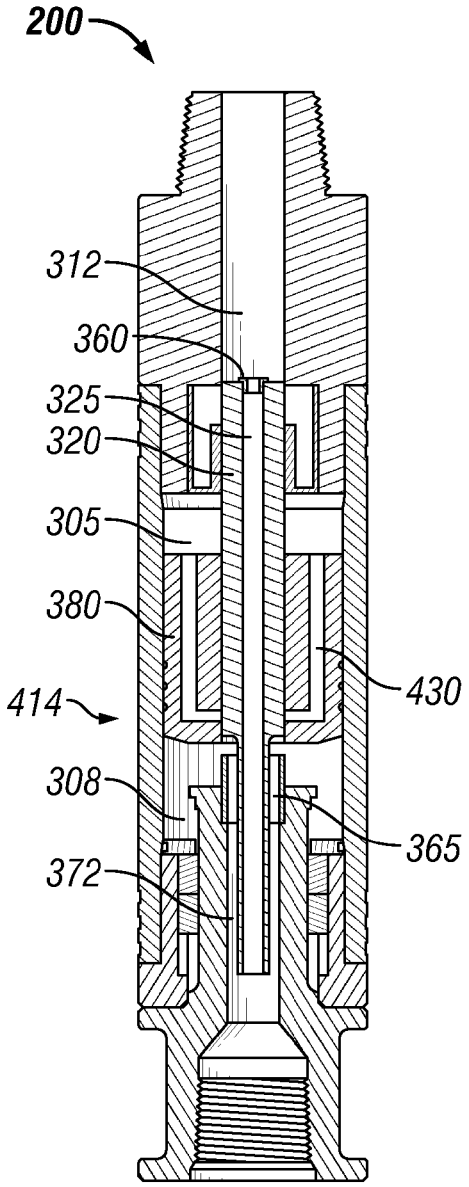

FIG. 4F-1 is a cross-sectional view of the percussion tool 200 with the piston 380 in an up position 414 and showing the positioning of the at least one first pressurized fluid conduit 386 and the at least one second pressurized fluid conduit 387 in accordance with an exemplary embodiment of the present invention. FIG. 4F-2 is a cross-sectional view of the percussion tool 200 with the piston 380 in the up position 414 and showing the positioning of the at least one top exhaust conduit 430 in accordance with an exemplary embodiment of the present invention. Referring to FIGS. 4F-1 and 4F-2, the piston 380 is positioned in the up position 414 and facilitates forming the top pressure fluid chamber 305 above it and the bottom pressure fluid chamber 308 below it. The bottom pressure fluid chamber 308 has increased in volume and the top pressure fluid chamber 305 has decreased in volume when compared to when the piston 380 was in the third intermediate upward moving position 413 (FIG. 4E-1). At this up position 414, the first pressurized fluid conduits 386 within the piston 380 are still in fluid communication with at least one respective second opening 328 of the feed tube 320 and hence communicates pressurized fluid from the outer feed tube channel 326 to the top pressure fluid chamber 305. However, at this up position 414, the second pressurized fluid conduits 387 within the piston 380 are not in fluid communication with any of the first openings 327 of the feed tube 320 and hence are not able to communicate pressurized fluid from the outer feed tube channel 326 to the bottom pressure fluid chamber 308. Thus, now only the top pressure fluid chamber 305 is filled with pressurized fluid while the bottom pressure fluid chamber 308 is not, when the piston 380 is at this up position 414. At this up position 414, the piston 380 is at its highest elevational position and the top pressure fluid chamber 305 is at its smallest volume. As the top pressure fluid chamber 305 continues to be filled with pressurized fluid and the pressure therein increases, the piston 380 will start falling, thereby eventually increasing the volume of the top pressure fluid chamber 305 and decreasing the volume of the bottom pressure fluid chamber 308. The pressurized fluid within the bottom pressure fluid chamber 308 continues to be exhausted through the exhauster 365 when the piston 380 is at this up position 414. This fluid proceeds from the bottom pressure fluid chamber 308, through the exhauster 365, through the mandrel passageway 372, and out the bit 290 (FIG. 2) through the check valve 302 (FIG. 3), if positioned within the bit 290 (FIG. 2), and the bit passageway 392 (FIG. 3). As the volume in the top pressure fluid chamber 305 is relatively constant, the fluid therein is pressurized more as more pressurized fluid enters the top pressure fluid chamber 305 and since the fluid therein is not exhausted through the exhauster 365. The at least one top exhaust conduit 430 is still not fluidly communicable with the exhauster 365. This pressurized fluid within the top pressure fluid chamber 305 causes the piston 380 to stop its upward movement. The excess pressurized fluid flowing from the sub passage 312, which is not used for filling the top pressure fluid chamber 305, flows into the central feed tube channel 325 of the feed tube 320 via the choke 360, then through the exhauster 365 into the mandrel passageway 372, and out the bit 290 (FIG. 2) through the check valve 302 (FIG. 3), if positioned within the bit 290 (FIG. 2), and the bit passageway 392 (FIG. 3). As seen, the pressurized fluid now enters only the top pressure fluid chamber 305 and therefore is not used to counteract, or work against, itself when being used to stop the movement of the piston 380.

Figures 1, 4G:
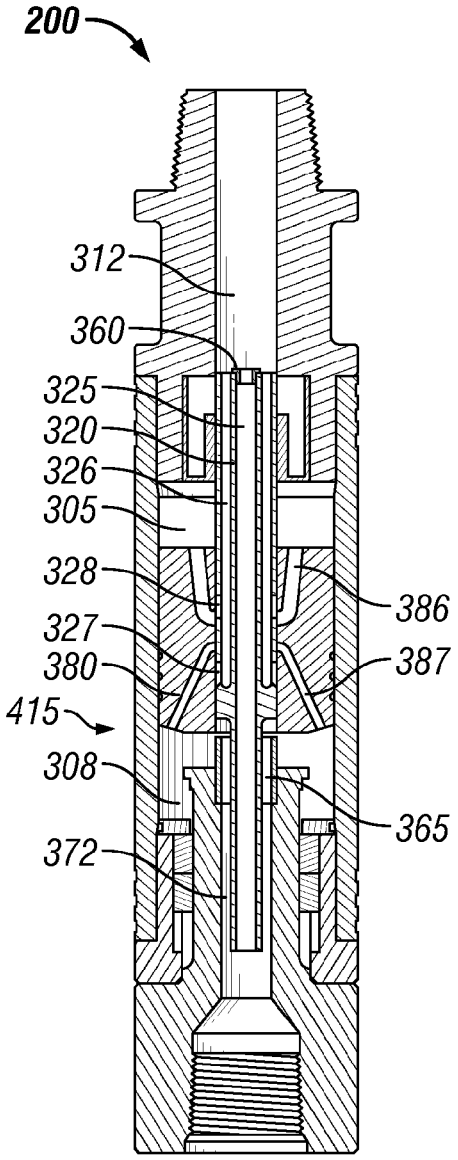
Figures 2, 4G:
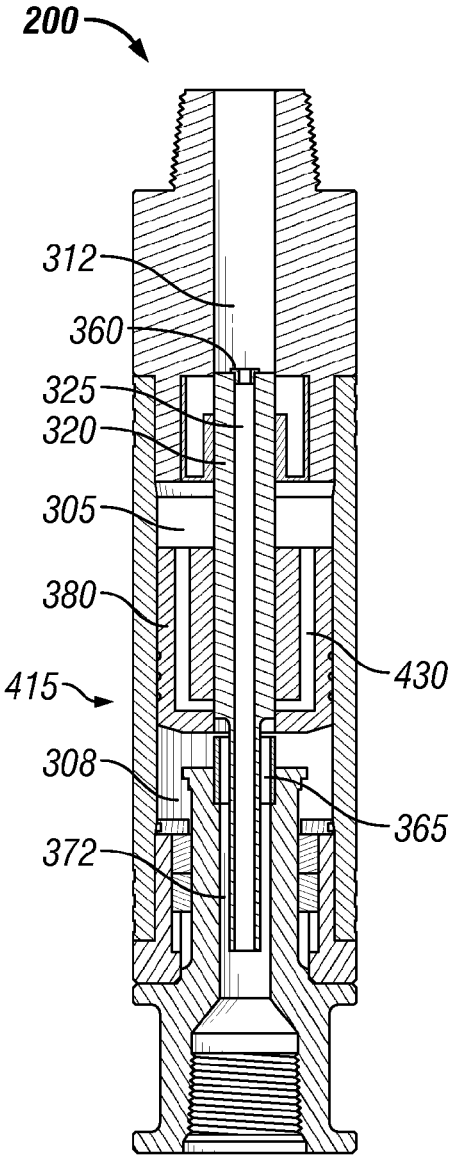

FIG. 4G-1 is a cross-sectional view of the percussion tool 200 with the piston 380 in a first intermediate downward moving position 415 and showing the positioning of the at least one first pressurized fluid conduit 386 and the at least one second pressurized fluid conduit 387 in accordance with an exemplary embodiment of the present invention. FIG. 4G-2 is a cross-sectional view of the percussion tool 200 with the piston 380 in the first intermediate downward moving position 415 and showing the positioning of the at least one top exhaust conduit 430 in accordance with an exemplary embodiment of the present invention. Referring to FIGS. 4G-1 and 4G-2, the piston 380 is positioned in the first intermediate downward moving position 415 and facilitates forming the top pressure fluid chamber 305 above it and the bottom pressure fluid chamber 308 below it. The bottom pressure fluid chamber 308 has decreased in volume and the top pressure fluid chamber 305 has increased in volume when compared to when the piston 380 was in the up position 414 (FIG. 4F-1). At this first intermediate downward moving position 415, the first pressurized fluid conduits 386 within the piston 380 are still in fluid communication with at least one respective second opening 328 of the feed tube 320 and hence continue to communicate pressurized fluid from the outer feed tube channel 326 to the top pressure fluid chamber 305. However, at this first intermediate downward moving position 415, the second pressurized fluid conduits 387 within the piston 380 are still not in fluid communication with any of the first openings 327 of the feed tube 320 and hence still does not communicate pressurized fluid from the outer feed tube channel 326 to the bottom pressure fluid chamber 308. Thus, only the top pressure fluid chamber 305 is filled with pressurized fluid while the bottom pressure fluid chamber 308 is not, when the piston 380 is at this first intermediate downward moving position 415. As the top pressure fluid chamber 305 continues to be filled and the pressure therein increases, the piston 380 continues falling, thereby further decreasing the volume of the bottom pressure fluid chamber 308 and further increasing the volume of the top pressure fluid chamber 305. The pressurized fluid within the top pressure fluid chamber 305 still does not exhaust through the exhauster 365 when the piston 380 is at this first intermediate downward moving position 415. As the volume in the bottom pressure fluid chamber 308 continues to decrease, the fluid therein continues to be exhausted to the outside environment through the exhauster 365 when the piston 380 is at this first intermediate downward moving position 415. This fluid proceeds from the bottom pressure fluid chamber 308, through the exhauster 365, through the mandrel passageway 372, and out the bit 290 (FIG. 2) through the check valve 302 (FIG. 3), if positioned within the bit 290 (FIG. 2), and the bit passageway 392 (FIG. 3). As the pressurized fluid enters the top pressure fluid chamber 305 and the pressurized fluid within the top pressure fluid chamber 305 is not exhausted, the fluid therein forces the piston 380 to move further downward. The at least one top exhaust conduit 430 is still not fluidly communicable with the exhauster 365. The excess pressurized fluid flowing from the sub passage 312, which is not used for filling the top pressure fluid chamber 305, flows into the central feed tube channel 325 of the feed tube 320 via the choke 360, then through the exhauster 365 into the mandrel passageway 372, and out the bit 290 (FIG. 2) through the check valve 302 (FIG. 3), if positioned within the bit 290 (FIG. 2), and the bit passageway 392 (FIG. 3). As seen, the pressurized fluid still enters only the top pressure fluid chamber 305 and therefore is not used to counteract, or work against, itself when being used to move the piston 380.

Figures 1, 4H:
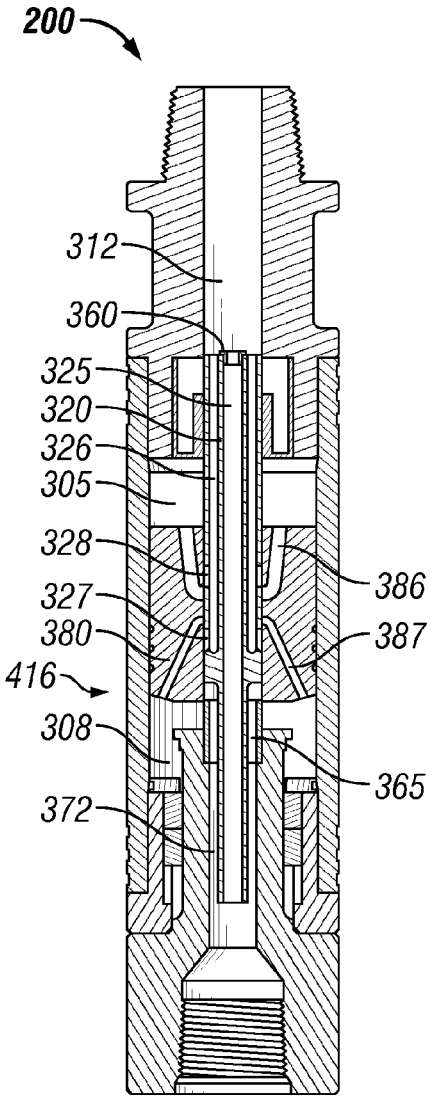
Figures 2, 4H:
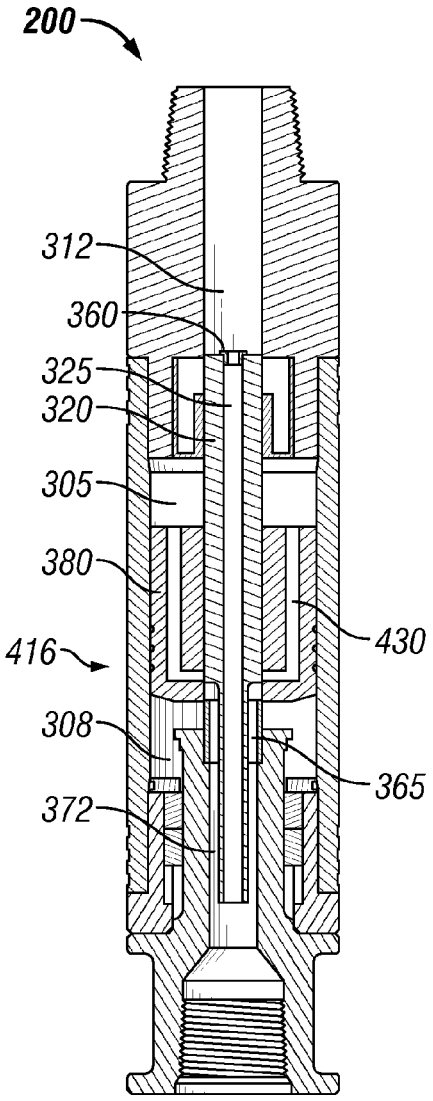

FIG. 4H-1 is a cross-sectional view of the percussion tool 200 with the piston 380 in a second intermediate downward moving position 416 and showing the positioning of the at least one first pressurized fluid conduit 386 and the at least one second pressurized fluid conduit 387 in accordance with an exemplary embodiment of the present invention. FIG. 4H-2 is a cross-sectional view of the percussion tool 200 with the piston 380 in the second intermediate downward moving position 416 and showing the positioning of the at least one top exhaust conduit 430 in accordance with an exemplary embodiment of the present invention. Referring to FIGS. 4H-1 and 4H-2, the piston 380 is positioned in the second intermediate downward moving position 416 and facilitates forming the top pressure fluid chamber 305 above it and the bottom pressure fluid chamber 308 below it. The top pressure fluid chamber 305 has further increased in volume and the bottom pressure fluid chamber 308 has further decreased in volume when compared to when the piston 380 was in the first intermediate downward moving position 415 (FIG. 4G-1). At this second intermediate downward moving position 416, the first pressurized fluid conduits 386 within the piston 380 are no longer in fluid communication with the second openings 328 of the feed tube 320 and hence do not communicate pressurized fluid from the outer feed tube channel 326 to the top pressure fluid chamber 305. Similarly, at this second intermediate downward moving position 416, the second pressurized fluid conduits 387 within the piston 380 also are not in fluid communication with any of the first openings 327 of the feed tube 320 and hence are not able to communicate pressurized fluid from the outer feed tube channel 326 to the bottom pressure fluid chamber 308. Thus, neither the top pressure fluid chamber 305 nor the bottom pressure fluid chamber 308 is filled with pressurized fluid, when the piston 380 is at this second intermediate downward moving position 416. However, the piston 380 continues moving in a downward direction from the forces previously applied to the top of the piston 380. Hence, as the piston 380 continues falling, the volume of the bottom pressure fluid chamber 308 continues to further decrease, while the volume of the top pressure fluid chamber 305 continues to further increase. The pressurized fluid within the top pressure fluid chamber 305 still does not exhaust through the exhauster 365 when the piston 380 is at this second intermediate downward moving position 416 since the top exhaust conduits 430 are not in fluid communication with the exhauster 365. Similarly, the fluid within the bottom pressure fluid chamber 308 no longer continues to exhaust through the exhauster 365 since the bottom pressure fluid chamber 308 is not in fluid communication with the exhauster 365. The excess pressurized fluid flowing from the sub passage 312, which is substantially all the pressurized fluid therein, flows into the central feed tube channel 325 of the feed tube 320 via the choke 360, then through the exhauster 365 into the mandrel passageway 372, and out the bit 290 (FIG. 2) through the check valve 302 (FIG. 3), if positioned within the bit 290 (FIG. 2), and the bit passageway 392 (FIG. 3). As seen, the pressurized fluid does not enter any of the top pressure fluid chamber 305 or the bottom pressure fluid chamber 308, and therefore is not used to counteract, or work against, itself when being used to move the piston 380.

Figures 1, 4I:
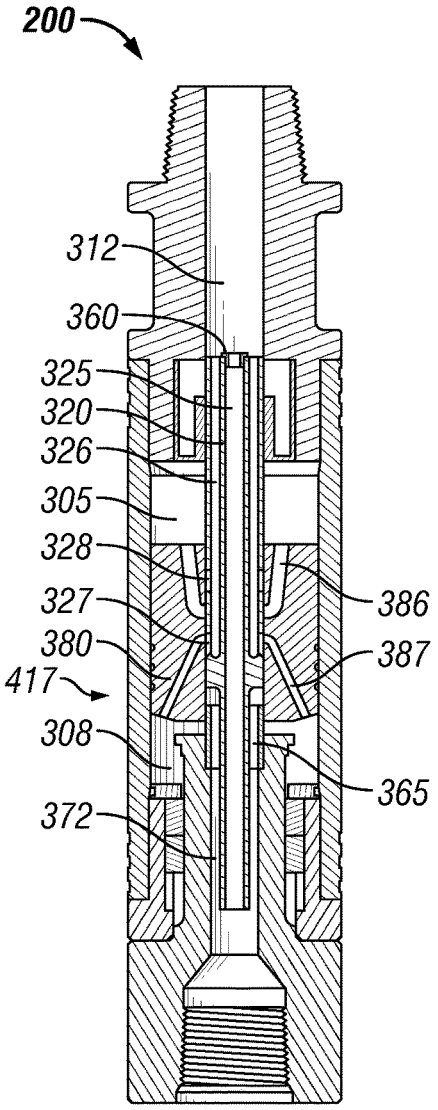
Figures 2, 4I:
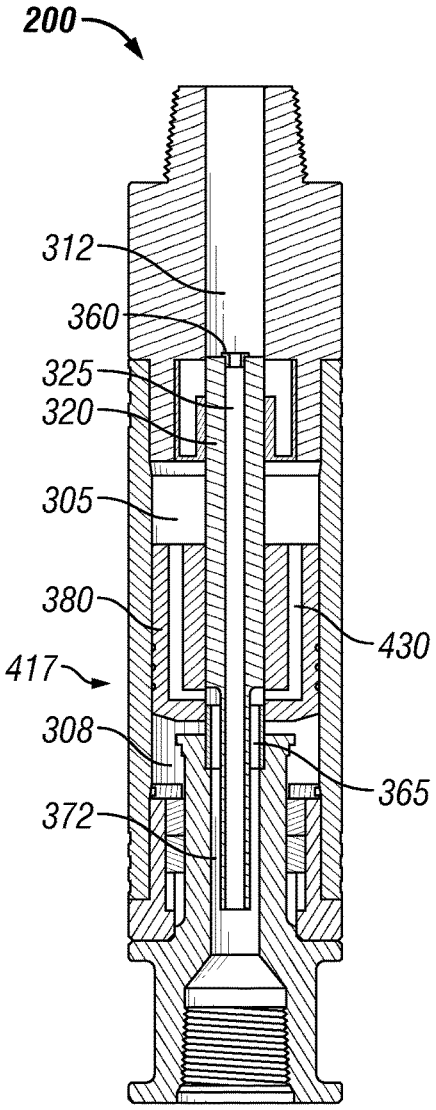

FIG. 4I-1 is a cross-sectional view of the percussion tool 200 with the piston 380 in a third intermediate downward moving position 417 and showing the positioning of the at least one first pressurized fluid conduit 386 and the at least one second pressurized fluid conduit 387 in accordance with an exemplary embodiment of the present invention. FIG. 4I-2 is a cross-sectional view of the percussion tool 200 with the piston 380 in the third intermediate downward moving position 417 and showing the positioning of the at least one top exhaust conduit 430 in accordance with an exemplary embodiment of the present invention. Referring to FIGS. 4I-1 and 4I-2, the piston 380 is positioned in the third intermediate downward moving position 417 and facilitates forming the top pressure fluid chamber 305 above it and the bottom pressure fluid chamber 308 below it. The top pressure fluid chamber 305 has increased in volume and the bottom pressure fluid chamber 308 has decreased in volume when compared to when the piston 380 was in the second intermediate downward moving position 416 (FIG. 4H-1). At this third intermediate downward moving position 417, the second pressurized fluid conduits 387 within the piston 380 are now in fluid communication with at least one respective first opening 327 of the feed tube 320 and hence communicates pressurized fluid from the outer feed tube channel 326 to the bottom pressure fluid chamber 308. However, at this third intermediate downward moving position 417, the first pressurized fluid conduits 386 within the piston 380 are not in fluid communication with any of the second openings 328 of the feed tube 320 and hence are not able to communicate pressurized fluid from the outer feed tube channel 326 to the top pressure fluid chamber 305. Thus, now only the bottom pressure fluid chamber 308 is filled with pressurized fluid while the top pressure fluid chamber 305 is not, when the piston 380 is at this third intermediate downward moving position 417. As the bottom pressure fluid chamber 308 is now filled with pressurized fluid and the pressure therein increases, the piston 380 continues falling but starts slowing down, thereby further decreasing the volume of the bottom pressure fluid chamber 308 and further increasing the volume of the top pressure fluid chamber 305. The pressurized fluid within the top pressure fluid chamber 305 now exhausts through the exhauster 365 when the piston 380 is at this third intermediate downward moving position 417. This fluid proceeds from the top pressure fluid chamber 305, through the at least one top exhaust conduit 430, through the exhauster 365, through the mandrel passageway 372, and out the bit 290 (FIG. 2) through the check valve 302 (FIG. 3), if positioned within the bit 290 (FIG. 2), and the bit passageway 392 (FIG. 3). As the volume in the bottom pressure fluid chamber 308 continues to decrease, the fluid therein is pressurized more since the fluid therein is not exhausted through the exhauster 365. The bottom pressure fluid chamber 308 is no longer fluidly communicable with the exhauster 365. This pressurized fluid within the bottom pressure fluid chamber 308 causes the piston 380 to slow down in its downward movement. The excess pressurized fluid flowing from the sub passage 312, which is not used for filling the bottom pressure fluid chamber 308, flows into the central feed tube channel 325 of the feed tube 320 via the choke 360, then through the exhauster 365 into the mandrel passageway 372, and out the bit 290 (FIG. 2) through the check valve 302 (FIG. 3), if positioned within the bit 290 (FIG. 2), and the bit passageway 392 (FIG. 3). As seen, the pressurized fluid now enters only the bottom pressure fluid chamber 308 and therefore is not used to counteract, or work against, itself when being used to slow the movement of the piston 380.

Figures 1, 4J:
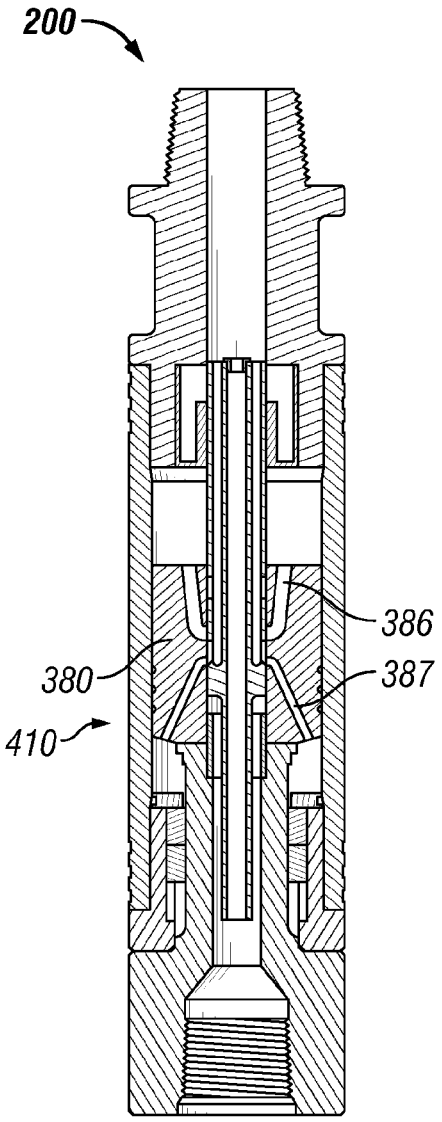
Figures 2, 4J:
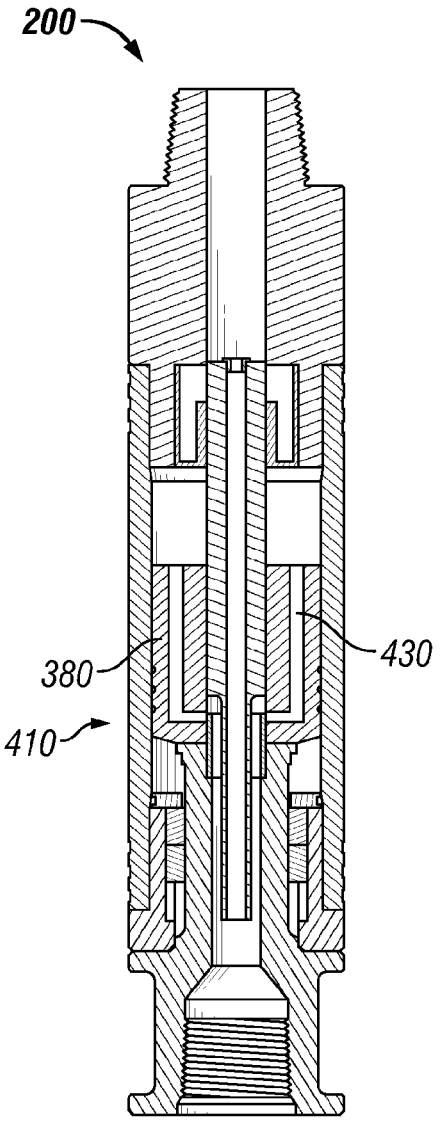

FIG. 4J-1 is a cross-sectional view of the percussion tool 200 with the piston 380 in the down position 410 and showing the positioning of the at least one first pressurized fluid conduit 386 and the at least one second pressurized fluid conduit 387 in accordance with an exemplary embodiment of the present invention. FIG. 4J-2 is a cross-sectional view of the percussion tool 200 with the piston 380 in the down position 410 and showing the positioning of the at least one top exhaust conduit 430 in accordance with an exemplary embodiment of the present invention. FIGS. 4J-1 and 4J-2 illustrate the piston 380 in the same position as illustrated in FIGS. 4B-1 and 4B-2 since the piston 380 has completed one movement cycle. Since FIGS. 4J-1 and 4J-2 illustrate the piston 380 in the same position as illustrated in FIGS. 4B-1 and 4B-2, the description previously provided with respect to FIGS. 4B-1 and 4B-2 also applies to the description of FIGS. 4J-1 and 4J-2; and therefore is not repeated again herein for the sake of brevity.

Although a few exemplary embodiments have been described and/or illustrated with respect to the components used in fabricating the percussion tool 200 and with respect to the operation of the percussion tool 200, modifications made with respect to these components and/or how the percussion tool 200 operates are envisioned to be included within the exemplary embodiments of this invention. For example, as previously mentioned, the check valve 302 may be placed upstream of the choke 360 or downstream of the choke 360, such as within the bit 290. Other types of modifications may be made such as reducing the number of components or increasing the number of components. Further, the connection type between the components may be altered without departing from the scope and spirit of the exemplary embodiments. Further, although the exemplary embodiments has been illustrated using a roller cone bit being coupled to the mandrel 270, other types of bits may be coupled to the mandrel 270, such as fixed cutter bits and hammers. Alternatively, these bits may be integrally formed with the mandrel 270 without departing from the scope and spirit of the exemplary embodiments.

Figure 5:
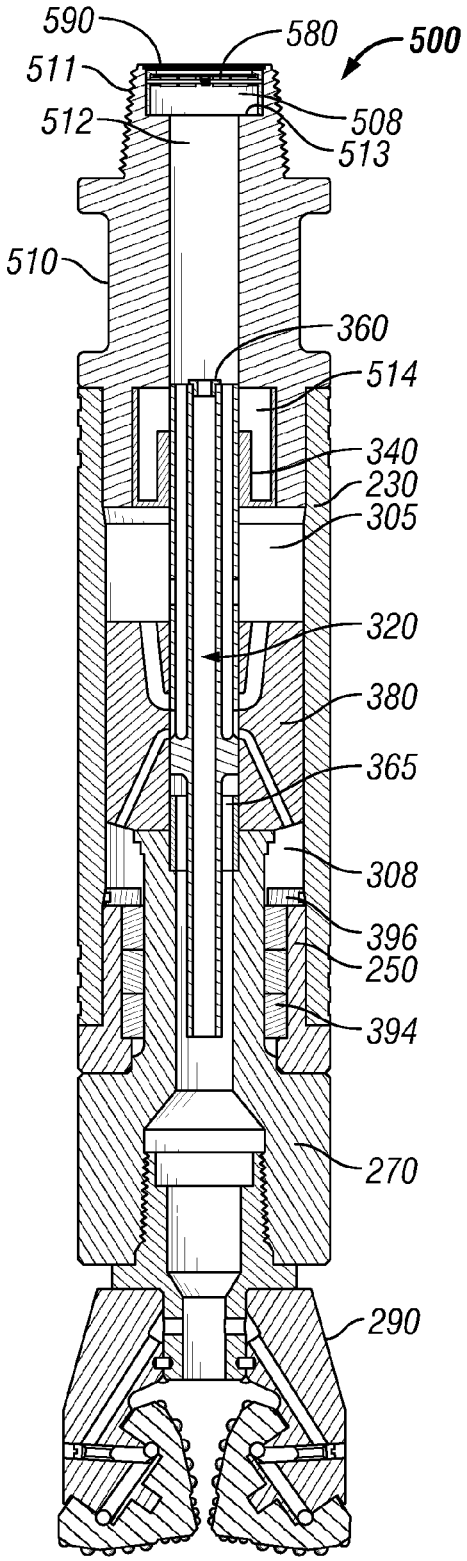
FIG. 5 is a cross-sectional view of a percussion tool in accordance with another exemplary embodiment of the present invention.

FIG. 5 is a cross-sectional view of a percussion tool 500 in accordance with another exemplary embodiment of the present invention. Referring to FIG. 5, the percussion tool 500 includes a top sub 510, a case 230, a drive sub 250, a mandrel 270, and a bit 290, which are viewable and accessible from exterior of the percussion tool 500. The percussion tool 500 further includes a feed tube 320, a feed tube mount 340, a choke 360, a piston 380, one or more drive lugs 394, an exhauster 365, a split retaining ring 396, a check valve 580, and a retaining ring 590, which are all positioned internally of the percussion tool 500. Although certain components have been mentioned, greater or fewer components may be included in the percussion tool 500 without departing from the scope and spirit of the exemplary embodiment. Further, one or more components may be combined or separated from another mentioned component without departing from the scope and spirit of the exemplary embodiment. Once the percussion tool 500 is assembled, a top pressure fluid chamber 305 and a bottom pressure fluid chamber 308 are formed.

Each of the case 230, the drive sub 250, the mandrel 270, the bit 290, the feed tube 320, the feed tube mount 340, the choke 360, the piston 380, the one or more drive lugs 394, the exhauster 365, the split retaining ring 396, the top pressure fluid chamber 305, and the bottom pressure fluid chamber 308 have been previously described. For the sake of brevity, these components are not described again herein.

Top sub 510 is similar to top sub 210 (FIG. 3) except that top sub 510 forms a first sub passage 508, a second sub passage 512, and a third sub passage 514 collectively extending therethrough. The first sub passage 508 is formed at a top end 511 of the top sub 510 and extends downwardly to the second sub passage 512. The first sub passage 508 is fluidly communicable with the second sub passage 512. The first sub passage 508 is larger in diameter than the second sub passage 512. The first sub passage 508 houses the check valve 580 and the retaining ring 590 therein according to certain exemplary embodiments. The first sub passage 508 is dimensioned to receive the check valve 580 and the retaining ring 590 in a secure manner. The second sub passage 512 is similar to sub passage 312 (FIG. 3) except that the second sub passage 512 extends from an end of the first sub passage 508 instead of from the top end 511 of the top sub 510, which is similar to the top end 312 (FIG. 3). Since the second sub passage 512 is similar to the sub passage 312 (FIG. 3), the details are not repeated herein for the sake of brevity. Further, the third sub passage 314 is fluidly communicable with the second sub passage 512. Since, the third sub passage 314 is similar to the secondary sub passage 314 (FIG. 3), it is therefore not described again in detail for the sake of brevity.

Figure 6A:
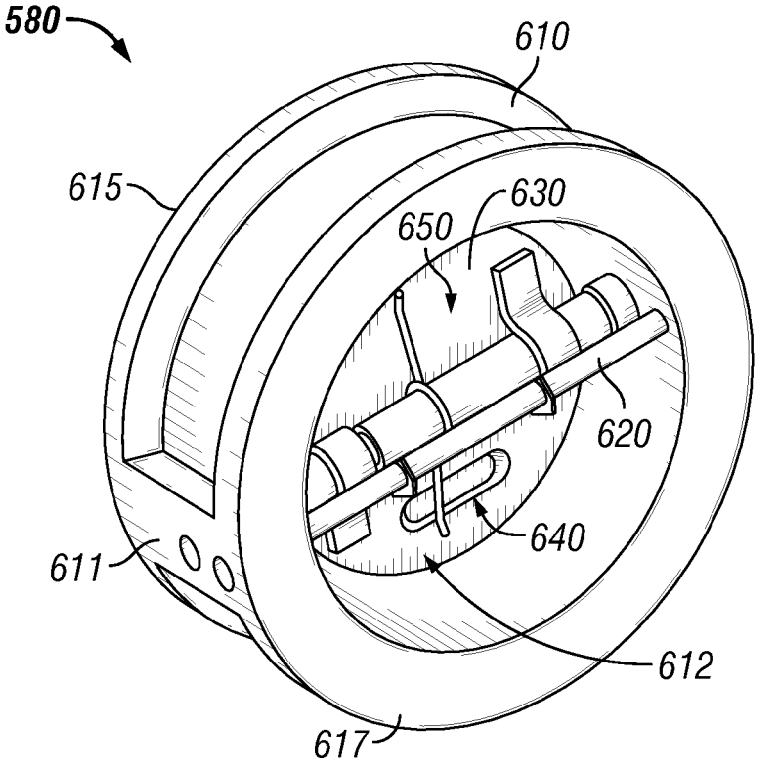
FIG. 6 A is a perspective view of a check valve used in the percussion tool of FIG. 5 in accordance with another exemplary embodiment of the present invention.
FIG. 6B is a cross-sectional view of the check valve of FIG. 6A in accordance with another exemplary embodiment of the present invention.
Figure 6B:
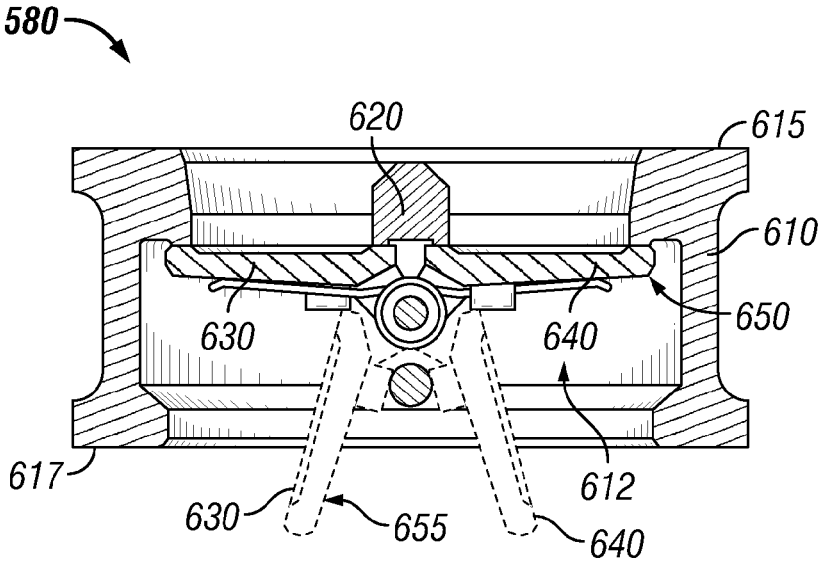

FIG. 6 A is a perspective view of the check valve 580 used in the percussion tool 500 in accordance with another exemplary embodiment of the present invention. FIG. 6B is a cross-sectional view of the check valve 580 in accordance with that exemplary embodiment of the present invention. Referring to FIGS. 5-6B, the check valve 580 is a butterfly valve that includes a housing 610, a spring clip 620, a first flap 630, and a second flap 640. The housing 610 is annularly shaped and forms a valve passageway 612 extending therethrough. The valve passageway 612 has a circular cross-section according to some exemplary embodiments. However, in other exemplary embodiments, the housing 610 and/or the valve passageway 612 have a different shape without departing from the scope and spirit of the exemplary embodiment. The outer surface 611 of the housing 610 is slightly smaller than the dimension of the first sub passage 508 such that the housing 610 is positioned securely within the first sub passage 508. According to some exemplary embodiments, the housing 610 is in contact with a platform 513 formed where the first sub passage 508 transitions into the second sub passage 512.

The spring clip 620 extends latitudinally across the diameter of the valve passageway 612. The first flap 630 extends outwardly from the spring clip 620 within the valve passageway 612 such that the first flap 630 occupies about half the cross-sectional area defined by the valve passageway when in a closed position 650, or biased position. Similarly, the second flap 640 extends outwardly from the spring clip 620 within the valve passageway 612 in an opposite direction than the first flap 630 when in a closed position 650, or biased position. The second flap 640 occupies about the remaining half of the cross-sectional area defined by the valve passageway 612. Hence, the spring clip 620, the first flap 630, and the second flap 640 collectively occupy substantially the cross-sectional area defined by the valve passageway 612, when the first flap 630 and the second flap 640 are in a closed position 650, or biased position. The first flap 630 and the second flap 640 are moveable from the closed position 650 to an open position 655 when air, or some other fluid, flows from a top end 615 of the housing 610 towards a bottom end 617 of the housing 610. The open position 655 is illustrated in FIG. 6B when the first flap 630 and the second flap 640 are in the dashed orientation. The spring clip 620 facilitates biasing the first flap 630 and the second flap 640 into the closed position 650 and allows for these flaps 630, 640 to open when air, or some other fluid flows from the top end 615 to the bottom end 617. According to some exemplary embodiments, the check valve 580 is placed into proper position, however, according to other exemplary embodiments, the check valve 580 may be threadedly coupled to the interior of the first sub passage 508 near the top end 511 of the top sub 510 or coupled according to any other method known to people having ordinary skill in the art.

The retaining ring 590 is a snap ring according to some exemplary embodiments and is configured to be positioned immediately adjacent the top end 615 of the housing 610. The retaining ring 590 is positioned at the top end 511 of the top sub 510 and prevents the check valve 580 from moving about unintentionally. According to some exemplary embodiments, the retaining ring 590 snaps into position, however, according to other exemplary embodiments, the retaining ring 590 may be threadedly couple to the interior of the first sub passage 508 at the top end 511 of the top sub 510 or coupled according to any other method known to people having ordinary skill in the art.

When the check valve 580 is positioned upstream of the choke 360, as illustrated in FIG. 5, the check valve 580 is easily removable such that maintenance or replacement of the choke 360 is able to be performed without dismantling, or disassembling, the percussion tool 500. For example, the retaining ring 590 is removed from the top end 511 of the top sub 510 via unthreading or unsnapping the retaining ring 590. The check valve 580 is then removed via removing or unthreading the check valve 580. Access to the choke 360 is now possible using a tool (not shown), such a rod with one or more features at its end. The tool is used to provide maintenance to the choke 360. In other exemplary embodiments, the tool is used to threadedly remove the choke 360 and replace the choke 360 with a different choke 360, of the same type or of a different type, such as a choke with a different diameter opening.

Figure 7A:
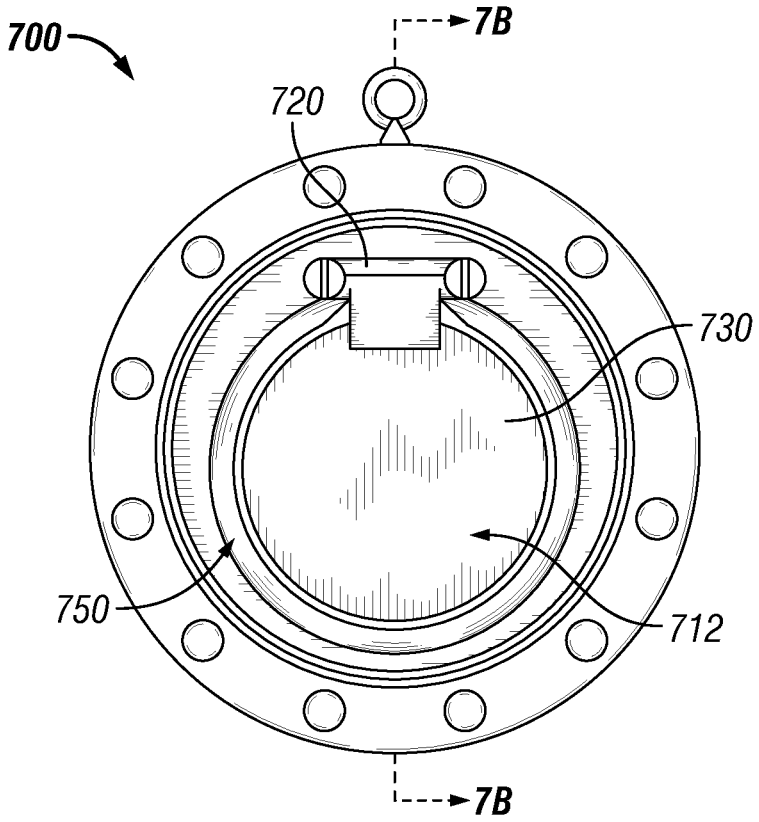
FIG. 7A is a bottom view of a check valve useable in the percussion tool of FIG. 5 in lieu of the check valve of FIGS. 6A and 6B, in accordance to yet another exemplary embodiment.
Figure 7B:
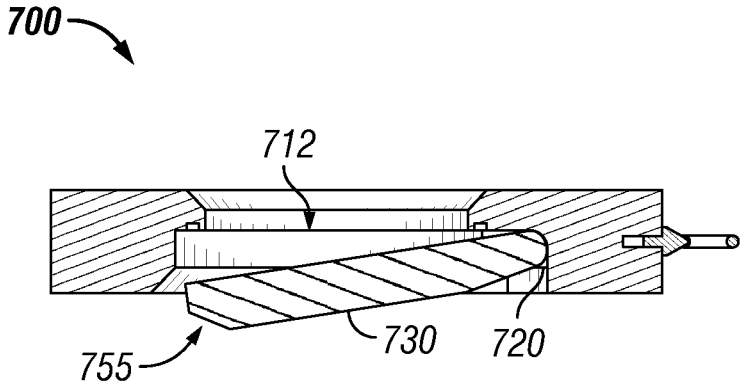
FIG. 7B is a cross-sectional view of the check valve of FIG. 7A in accordance with that exemplary embodiment of the present invention.

FIG. 7A is a bottom view of a check valve 700 useable in the percussion tool 500 (FIG. 5) in lieu of the check valve 580 (FIGS. 5-6B) in accordance to yet another exemplary embodiment. FIG. 7B is a cross-sectional view of the check valve 700 in accordance with that exemplary embodiment of the present invention. The check valve 700 is similar to check valve 580 (FIGS. 5-6B), except that check valve 700 includes a spring clip 720 and a single flap 730. The spring clip 720 is similar to spring clip 620 (FIGS. 6A and 6B), except that the spring clip 720 is positioned near a perimeter of a valve passageway 712, which is similar to the valve passageway 612 (FIGS. 6A and 6B). The spring clip 720 is configured to bias the single flap 730 in a closed position 750. The single flap 730 is moveable from a closed position 750 to an open position 755 and back again in a similar manner that that the first flap 630 (FIGS. 6A and 6B) and the second flap 640 (FIGS. 6A and 6B) are moved. The single flap 730 is moveable into an even more open position 755 than illustrated in FIG. 7B. Hence, the check valve 580, 700 can have one or more flaps, including more than two flaps, if desired. Further, the check valve 700 operates in a similar manner as check valve 580 (FIGS. 5-6B) and is removable in a similar manner as check valve 580 (FIGS. 5-6B) such that maintenance or replacement of the choke 360 is able to be performed without dismantling, or disassembling, the percussion tool 500.

Figure 1A:
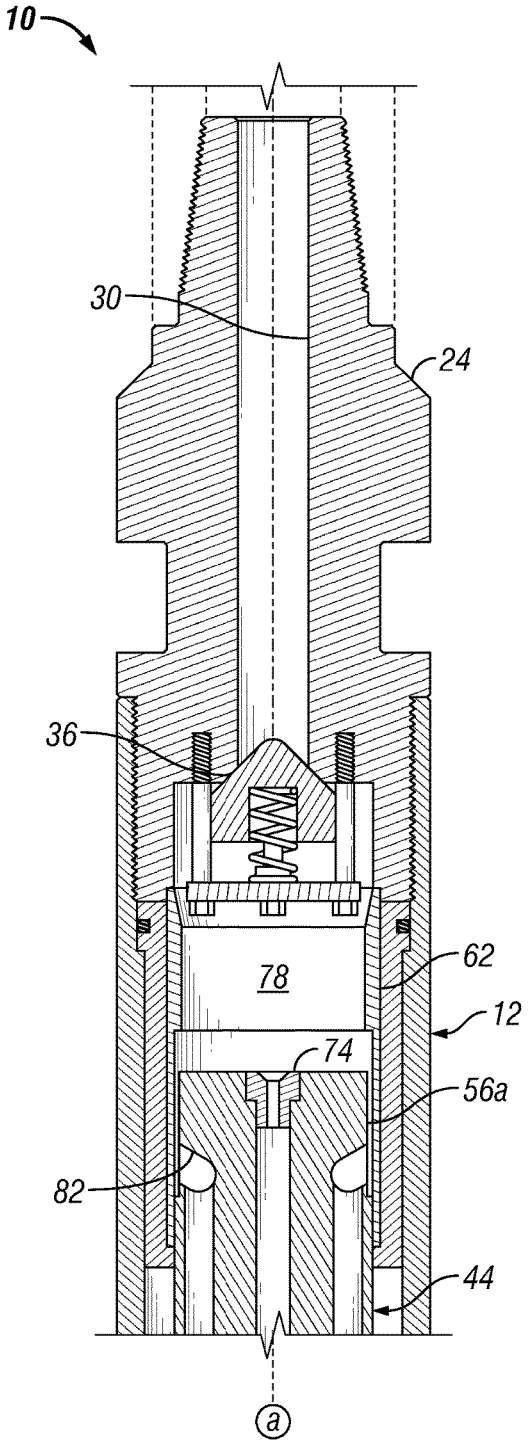
FIG. 1A (Prior Art)
FIG. 1A is a longitudinal cross-sectional view of a portion of a conventional downhole percussion tool in accordance with the prior art.
Figure 1B:
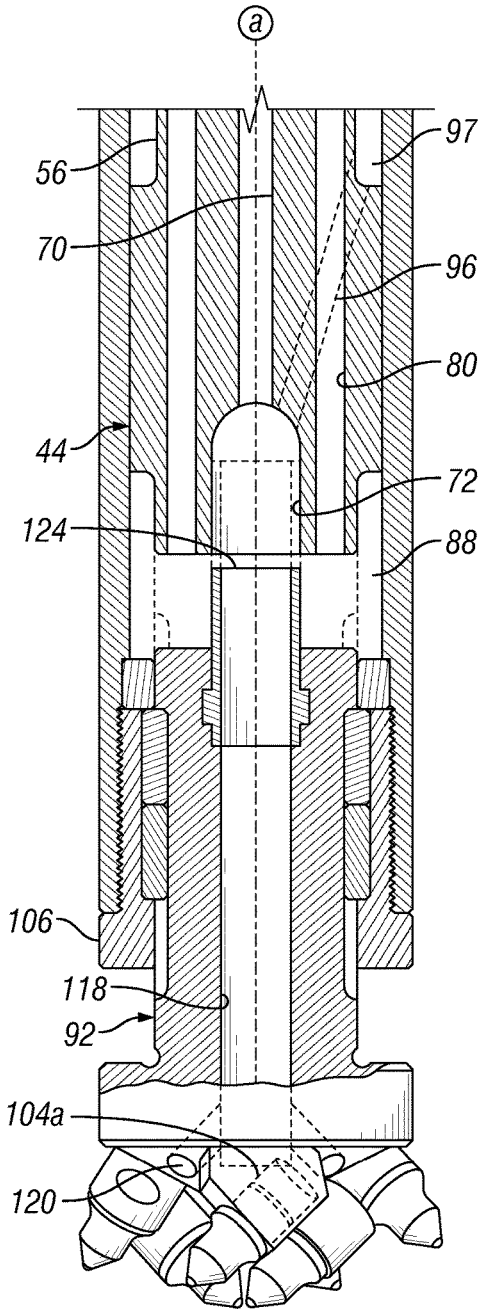
FIG. 1B (Prior Art)
FIG. 1B is a longitudinal cross-sectional view of a remaining portion of the conventional downhole percussion tool of FIG. 1A whereby
Figure 8A:
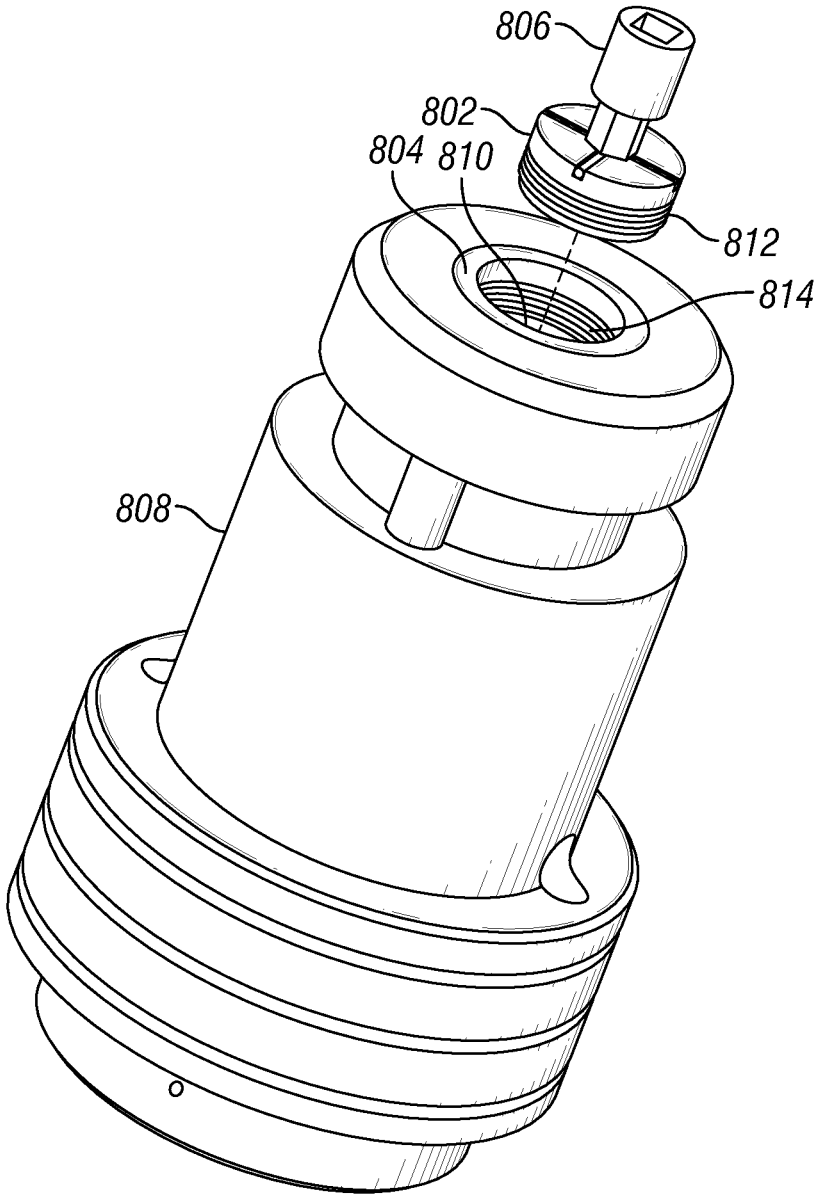
FIG. 8A illustrates a choke and a choke adapter that is coupled to a piston of a percussion tool in accordance with an exemplary embodiment of the present invention.
Figure 8B:
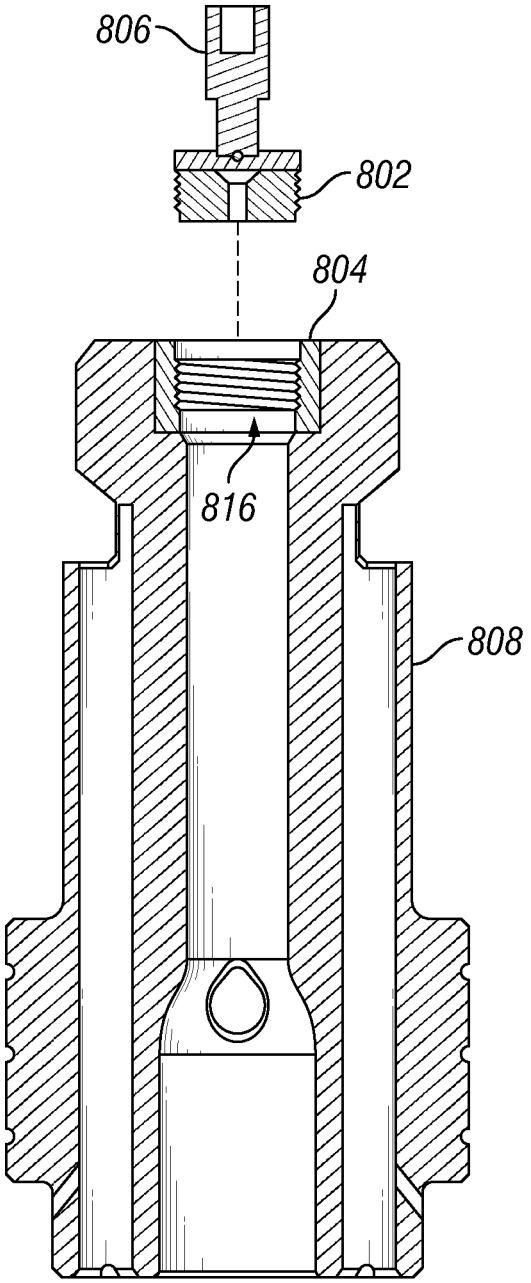
FIG. 8B illustrates a cross-sectional view of the choke and the choke adapter of FIG. 8A in accordance with an exemplary embodiment of the present invention.

FIG. 8A illustrates a choke 802 and a choke adapter 804 that is coupled to a piston 808 of a percussion tool, such as the conventional downhole percussion tool 10 of FIGS. 1A-B, in accordance with an exemplary embodiment of the present invention. FIG. 8B illustrates a cross-sectional view of the choke 802 and the choke adapter 804 of FIG. 8A in accordance with an exemplary embodiment of the present invention. In some exemplary embodiments, the choke 802 and the choke adapter 804 form a choke assembly that is used to control flow of a fluid into a piston 808 of a percussion tool. Referring to FIGS. 8A and 8B, the choke 802 is a removable choke that may be attached to and removed from the piston 808 of a percussion tool, such as the percussion tool 1100 of FIGS. 11A-11D. For example, the choke 802 can be installed on the piston 808 by attaching the choke 802 to the choke adapter 804 using the choke change tool 806. As illustrated in FIGS. 8A and 8B, the choke adapter 804 is inserted into the piston 808.

The choke adapter 804 includes an adapter opening 810 for receiving the choke 802. The choke adapter 804 may be inserted into the piston 808 by pressing the choke adapter 804 into a piston opening 816 (more clearly shown in FIG. 8B). To illustrate, the choke adapter 804 may be sized to firmly fit into the piston opening 816 such that once the choke adapter 804 is inserted into the piston opening 816 by applying pressure (i.e., pressure fit), the choke adapter 804 may firmly grip an inner wall of the piston 808 at the piston opening 816. In some exemplary embodiments, the choke adapter 804 may be flush with the top surface of the piston 808 when the choke adapter 804 is fully inserted into the piston 808 as illustrated in FIG. 8A.

In some example embodiments, an outer wall 812 of the choke 802 is threaded for attaching the choke 802 to the choke adapter 804. As illustrated in FIG. 8A, in some exemplary embodiments, the inner wall 814 of the choke adapter 804 surrounding the adapter opening 810 is also threaded. For example, the inner wall 814 of the choke adapter 804 and the outer wall 812 of the choke 802 may be threaded such that the choke 802 can be screwed onto the choke adapter 804. For example, the choke 802 may be attached to the choke adapter 804 by screwing the choke 802 into the choke adapter 804. In particular, the choke 802 may be attached to the adapter opening 810 by inserting the choke 802 into the adapter opening 810. The choke 802 may be attached to the choke adapter 804 using the choke change tool 806. To illustrate, when the choke 802 and the choke adapter 804 are threaded, for example, as illustrated in FIG. 8A, an operator may turn the choke change tool 806 attached to the choke 802 in a direction (e.g., clockwise) such that the choke 802 is screwed onto the choke adapter 804. In some exemplary embodiments, once the choke 802 is attached to the choke adapter 804, the piston 808 may be installed in a percussion tool, such as the percussion tool 1100 shown in FIGS. 11A and 11B.

In some exemplary embodiments, FIGS. 8A and 8B illustrate the choke 802 after the choke 802 is decoupled from the choke adapter 804. For example, the choke change tool 806 may be used to unscrew the choke 802 from the choke adapter 804, for example, to change the choke 802 with a second choke that may have a different size opening (where the choke change tool 806 is inserted into the choke 802). To illustrate, an operator may turn the choke change tool 806 attached to the choke 802 in a direction (e.g., counterclockwise) such that the choke 802 is unscrewed from the choke adapter 804. After the choke 802 is removed from the choke adapter 804, a second choke (not shown) may be inserted using the choke change tool 806 in the manner described above.

In some exemplary embodiments, the choke adapter 804 may be made from metal or other suitable material. The choke adapter 804 may be made by methods such as molding. Alternatively, the choke adapter 804 may be cut out of a larger material and threaded using methods known to those of ordinary skill in the art. The choke adapter 804 can also be made using methods such as rapid prototyping or "3-D printing" as well as other methods known to those of ordinary skill in the art having the benefit of the present disclosure.

Figure 12:
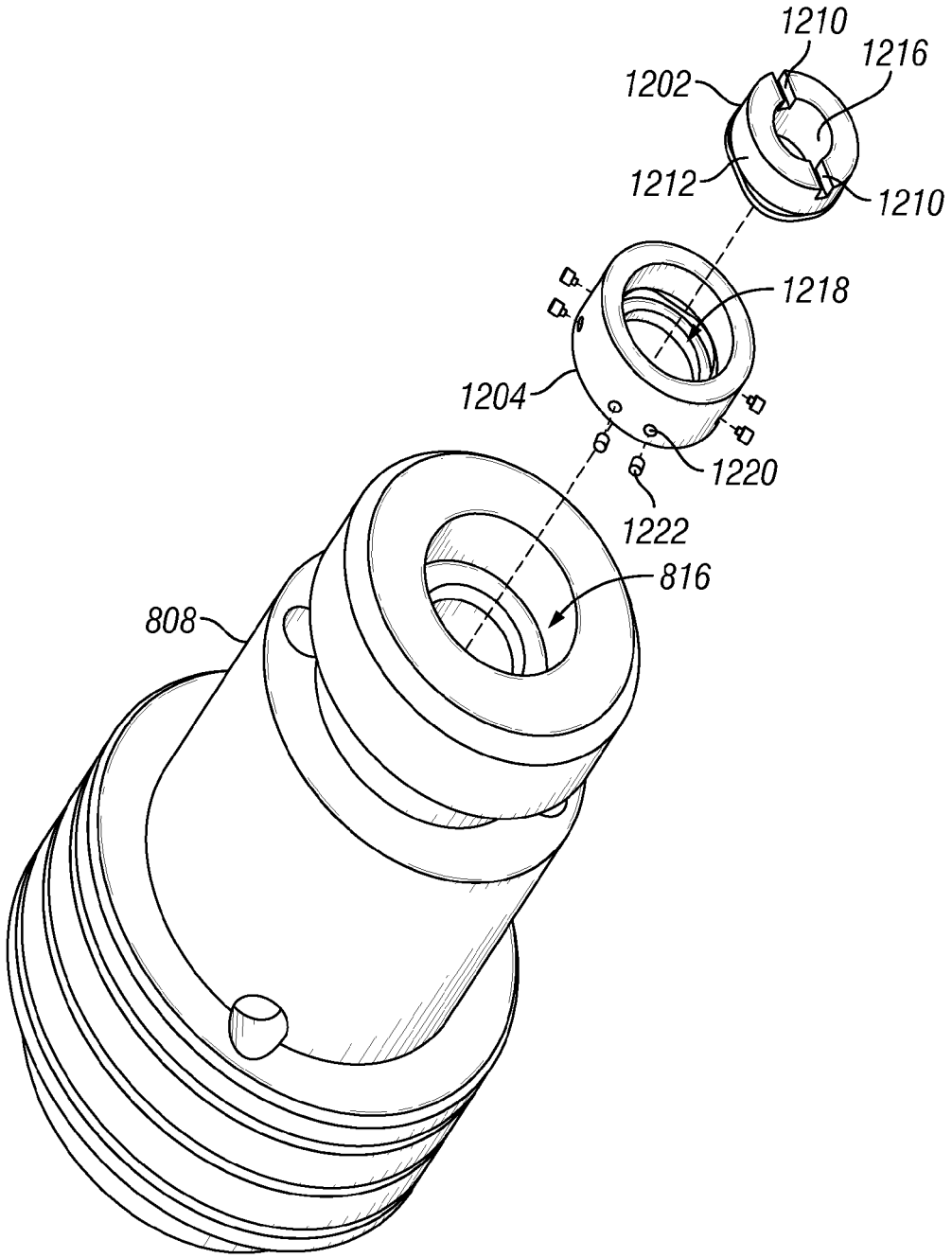
FIG. 12 illustrates a choke and a choke adapter prior to attachment to a piston of a percussion tool in accordance with another exemplary embodiment of the present invention.

Although the choke 802 and choke adapter 804 have a substantially circular outer shape as illustrated in FIG. 8A, in alternative embodiment, the choke 802 and choke adapter 804 may have other outer shapes without departing from the scope of this disclosure. For example, the choke adapter 804 may be designed to have a shape that matches the shape of the piston opening 816. Further, the adapter opening 810 may have other shapes than shown in FIG. 8A that match other shapes of the choke 802 without departing from the scope of this disclosure. Furthermore, although the choke 802 and the choke adapter 804 are threaded for threaded attachment with each other, in alternative embodiments, the choke 802 and the choke adapter 804 may not be threaded and may be attached to each other using other means such as shown in FIG. 12.

Although a particular portion of the outer wall 812 of the choke 802 and a particular portion of the inner wall 814 of the choke adapter 804 are shown as threaded, in alternative embodiments, smaller or larger portions of the outer wall 812 and the inner wall 814 may be threaded. Further, although the piston 808 is shown in FIGS. 8A and 8B to have a particular shape, in alternative embodiments, the piston 808 may have other external shapes and contours without departing from the scope of this disclosure. Furthermore, although the choke adapter 804 is attached to the piston 808 as illustrated in FIGS. 8A and 8B, in some alternative exemplary embodiments, the piston 808 may be threaded such that the choke 802 can be screwed directly to the piston a manner similar to how the choke 802 would be screwed onto the choke adapter 804.

Figure 9A:
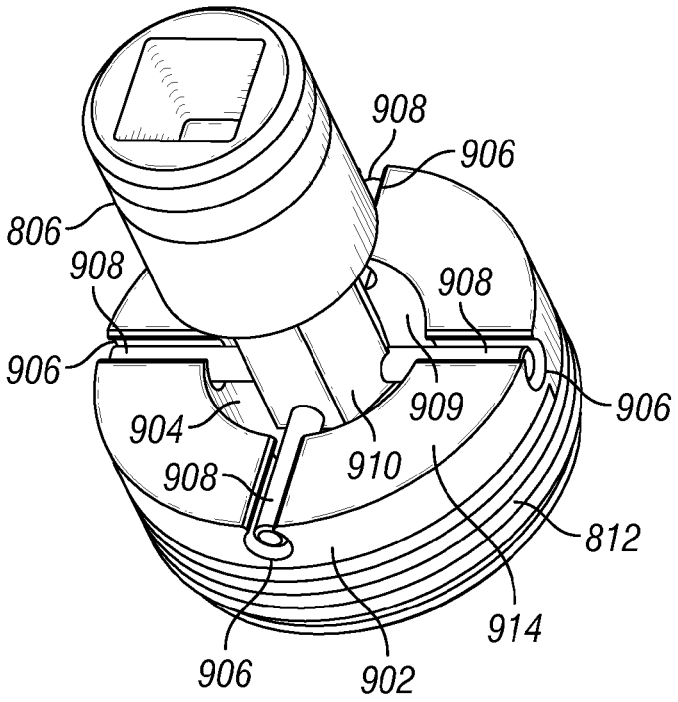
FIGS. 9A-9B illustrate different views of the choke of FIG. 8A including the choke change tool attached to the choke in accordance with an exemplary embodiment of the present invention.
Figure 9B:
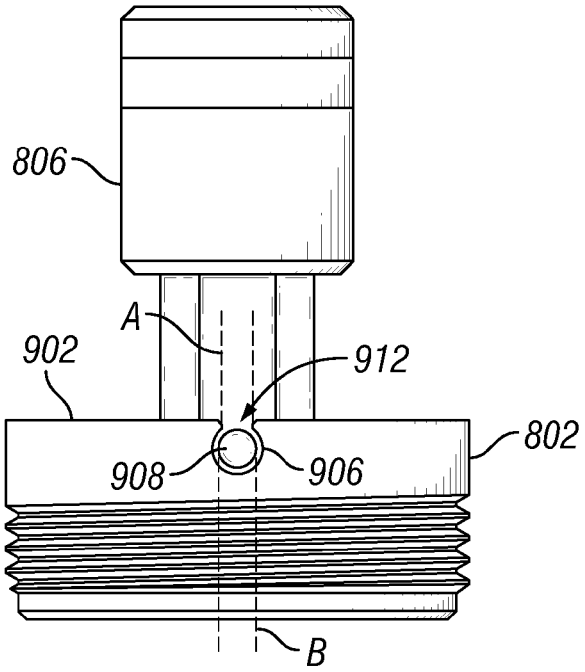

FIGS. 9A-9B illustrate views of the choke 802 of FIG. 8A including the choke change tool 806 attached to the choke 802 in accordance with an exemplary embodiment of the present invention. In some exemplary embodiments, the choke 802 may be made from metal or another suitable material known to those of ordinary skill in the art. Referring to FIG. 9A, the choke change tool 806 may be used to attached and decouple the choke 802 to a choke adapter, such as the choke adapter 804 of FIGS. 8A and 8B. The choke change tool 806 may be attached to the choke 802 in the manner shown in FIGS. 9A and 9B to attached or decouple the choke adapter 804.

In some exemplary embodiments, the choke 802 includes a choke body 902 and a choke opening 904. The choke 802 also includes four arm slots 906 that are formed into the choke body 902. In some exemplary embodiments, the arm slots 906 may be elongated slots as illustrated in FIG. 9A. For example, the arm slots 906 may extend from an inner wall 909 of the choke body 902 to the outer wall 812 of the choke body 902. The arm slots 906 are designed to receive respective arms 908 of the choke change tool 806. The arms 908 extend out from a lower segment 910 of the choke change tool 806. As illustrated in FIG. 9A, the lower segment 910 of the choke change tool 806 may be positioned in the choke opening 904. In some example embodiments, use of the four arms 908 maintains the choke change tool 806 centered in the choke 802 and reduces the risk of the choke 802 slipping along the arms 908.

As illustrated in FIG. 9A, the inner wall 909 extends around a choke opening 904. The choke opening 904 is designed for fluid to flow therethrough. In particular, the choke opening 904 may have a size that allows a desired flow of a fluid into a piston, such as the piston 808 of FIGS. 9A and 9B, when the choke 802 is attached to a choke adapter that is coupled to the piston. For example, the choke opening 904 may have a diameter that allows a desired flow of a fluid into the piston 808 when the choke 802 is attached to the choke adapter 804 as described with respect to FIGS. 8A an 8B. Generally, the choke 802 may be designed with different diameters of the choke opening 904.

Referring to FIGS. 9A and 9B, the arm slots 906 may have openings 912 that extend along the top surface 914 of the choke body 902. In some exemplary embodiments, the arms 908 may be attached to the choke 802 by inserting the arms 908 into the arm slots 906 through the openings 912. For example, the arms 908 may be inserted into the arm slots 906 by pushing the arms 908 into the arm slots 906 with adequate force. Similarly, the arms 908 may be detached from the choke 802 by pulling the arms 908 out of the arm slots 906 with adequate force. The arms 908 are pulled out of the arm slots 906 through the opening 912.

To illustrate, the width A of the openings 912 of the arm slots 906 is smaller than the width B of the arms 908. In some exemplary embodiments, the width B of the arms 908 is the same as the diameter of the arms 908. Because the choke 802 may be made form an elastically deformable material known to those of ordinary skill in the art, the arms 908 may be forcefully pushed into and pulled out of the arm slots 906. For example, if the choke 802 is threadedly attached to the choke adapter 804 of FIG. 8A, pulling the choke change tool 806 that is attached to the choke 802 with increasing force results in the arms 908 of the choke change tool 806 being snapped/pulled out of the arm slots 906. However, once the choke 802 is unscrewed from the choke adapter 804, pulling the choke change tool 806 that is attached to the choke 802 will remove the choke 802 from the choke adapter 804 while maintaining the choke 802 attached to the choke change tool 806. Thus, the width A of the openings 912 and the width B of the arms 908 can be sized relative to each other such that the choke 802, once attached to the choke change tool 806 via the arms 908, is not detached from the choke change tool 806 because of the weight of the choke 802.

In some exemplary embodiments, the choke 802 may be made by methods such as molding. Alternatively, the choke body 902 may be cut out of a larger material and the choke opening 904 and the arm slots 906 may be cut/carved out of the choke body 902. The threads may be formed on the outer wall 812 using methods known to those of ordinary skill in the art. The choke 802 can also be made using methods such as rapid prototyping or "3-D printing" as well as other methods known to those of ordinary skill in the art having the benefit of the present disclosure.

Although the arm slots 906 are shown in FIG. 9A as extending between the inner wall 909 and the outer wall 812 of the choke body 902, in alternative embodiments, the arm slots 906 may be shorter than illustrated in FIG. 9A and may not extend to the outer wall 812. Further, in some alternative embodiments, the arm slots 906 may not be equally spaced around the perimeter of the choke opening 904 while matching corresponding spacing of the arms 908. Furthermore, although four arm slots 906 are illustrated in FIG. 9A, in alternative embodiments, the choke 802 may have fewer or more than four arm slots that match the number of arms on a choke change tool. In some example embodiments, the choke 802 may have more arm slots than the number of arms on the choke change tool 806. For example, the choke change tool 806 may have three arms that may be used to attach or remove the choke 802 having more than three (e.g., six) arm slots to/from the piston 808 using three of the arm slots on the choke 802.

Figure 10:
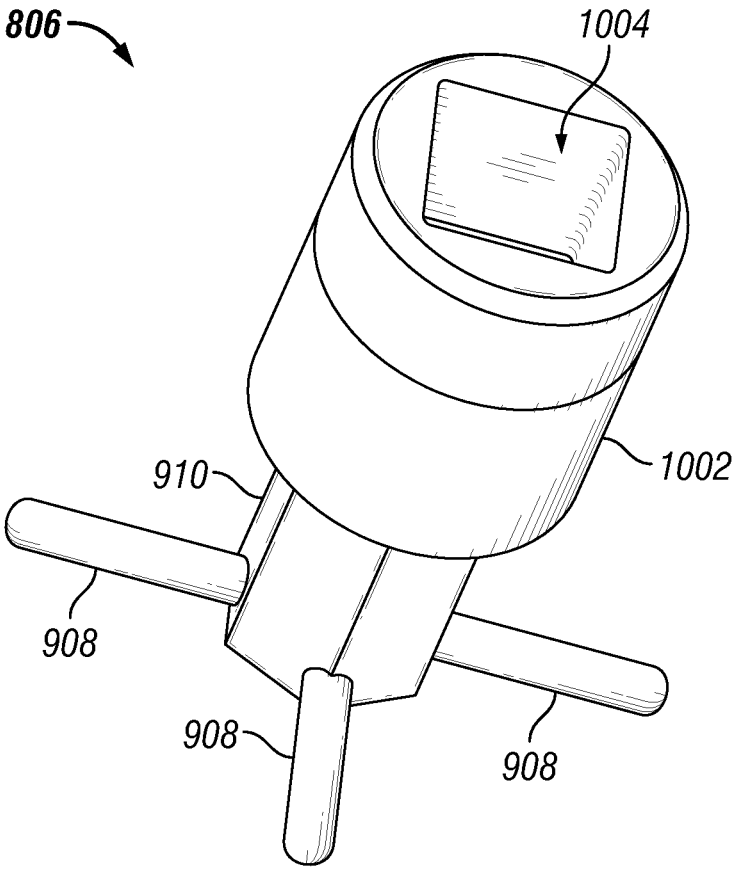
FIG. 10 illustrates a perspective view of the choke change tool of FIG. 8A in accordance with an exemplary embodiment of the present invention.

FIG. 10 illustrates a perspective view of the choke change tool 806 in accordance with an exemplary embodiment of the present invention. As described above, the choke change tool 806 can be used to attach and remove the choke 802 to/from the choke adapter 804 of FIGS. 9A and 9B. In some example embodiments, the choke change tool 806 is made from metal. As illustrated in FIG. 10, the choke change tool 806 includes an upper segment 1002 and the lower segment 910 extending down from the upper segment 1002. The upper segment 1002 includes a cavity 1004 that is designed to receive a rod, such as a rod 1110 shown in FIGS. 11A and 11 B. In some exemplary embodiments, the choke change tool 802 may be attached to the rod 1110 in a manner similar to how a socket is attached to a socket wrench extension rod or to the drive of the socket wrench ratchet. For example, the choke change tool 806 may be designed to attach to a standard ¼", ⅜", ½", ¾", or 1" drive of a ratchet or extension rod. To illustrate, one or more detents formed inside the cavity 1004 can be used for attachment of the rod 1110 that may have one or more corresponding spring-loaded balls.

As illustrated in FIG. 10, the arms 908 extend out from the lower segment 910 of the choke change tool 806. For example, the arms 908 may be spaced to match the spacing of arm slots, such as the arm slots 906 of the choke 802 shown in FIG. 9A. As described above, the arms 908 can engage the corresponding arm slots 906 to attach and remove the choke 802 to/from the choke adapter 804. The diameter of the arms 908 is sized such that the arms 908 can be pushed into the arm slots 906 that have relatively narrower openings 912. Once the arms 908 are engaged with the arm slots 906, the choke tool 806 can be used to rotate the choke 802 to screw the choke 802 into the adapter opening 810 shown in FIG. 8A. Similarly, the choke tool 806 can be used to rotate the choke 802 to unscrew the choke 802 out of the adapter opening 810.

Although the choke change tool 806 is shown to have four arms 908 (as more clearly shown in FIG. 9A), in some exemplary embodiments, the choke change tool 806 may have fewer or more than four arms 908 extending out from the lower segment 910. Further, although the lower segment 910 has a smaller width than the upper segment 1002 as illustrated in FIG. 10, in alternative embodiments, the lower segment 910 and the upper segment 1002 may have the same dimensions. Furthermore, the choke change tool 806 may have a different shape and/or different dimensions than shown or suggested by FIG. 10 without departing from the scope of this disclosure.

Figure 11A:
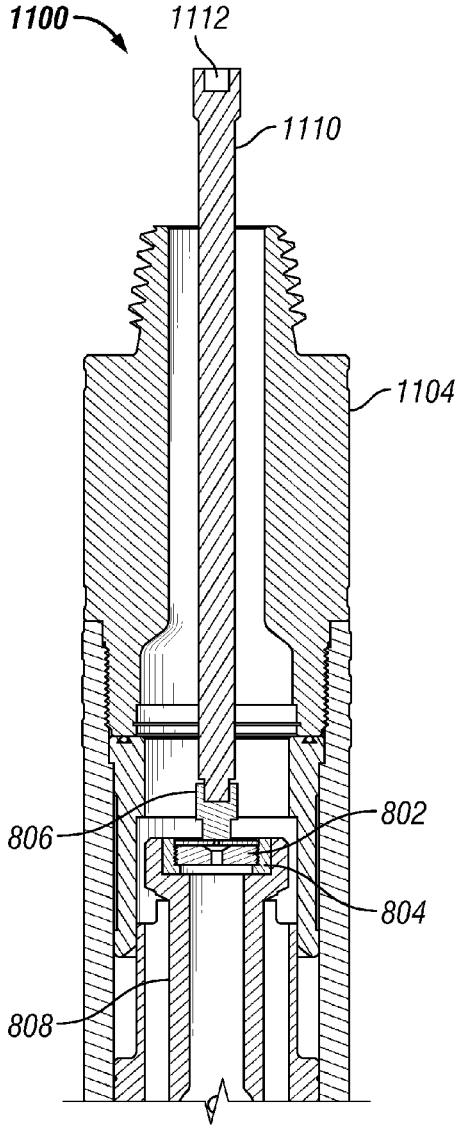
FIGS. 11A-11D illustrate cross-sectional views of a percussion tool including stages of replacement of the choke of FIG. 8A with a replacement choke in accordance with an exemplary embodiment of the present invention.
Figure 11B:
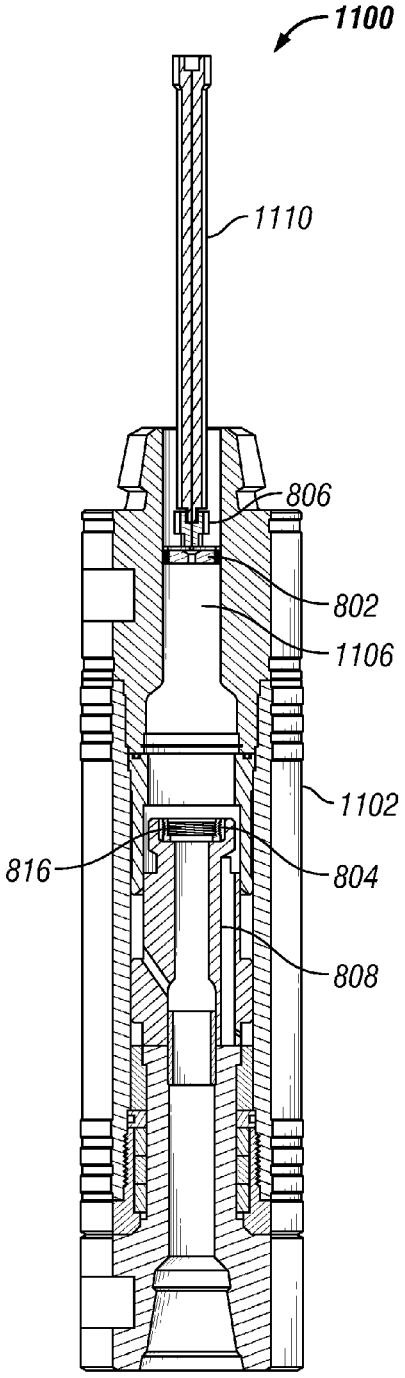

FIGS. 11A-11D illustrate cross-sectional views of a percussion tool 1100 including stages of replacement of the choke 802 with a replacement choke 1114 in accordance with an exemplary embodiment of the present invention. Referring to FIGS. 11A and 11B, the percussion tool 1100 includes a casing 1102, a top sub 1104, and the piston 808 disposed in the casing 1102 below the top sub 1104. For example, the percussion tool 1100 may be a downhole percussion tool such as a rotary percussion tool that is used in oil and gas drilling operations.

As illustrated in FIGS. 11A-11D, the rod 1110 is attached to the choke change tool 806, and the choke change tool 806 is attached to the choke 802. The rod 1110 may be attached to the choke change tool 806 as described with respect to FIG. 10. For example, the rod may have one or more spring-loaded balls and the choke change tool 806 may have one or more corresponding detents. The choke change tool 806 may be removably attached to the rod 1110 by other means known to those of ordinary skill in the art as long as the force required to remove the rod 1110 from the choke change tool 806 is greater than the force required to remove the choke change tool 806 from the choke 802, for example, by snapping the arms 908 out of the arm slots 906 shown in FIG. 9A. Alternatively, the rod 1110 may be permanently affixed to the choke change tool 806 with an adhesive material, by welding or other means. The rod 1110 and the choke change tool 806 may also be integrally formed. For example, both the choke change tool 806 and the rod 1110 may be integrally made from a metal such as steel.

FIG. 11A illustrates the choke 802 during the process of detaching the choke 802 from the piston 808. The choke change tool 806 and the rod 1110 are extended through a passageway 1106 of the percussion tool 1100. Similarly, FIG. 11B illustrates the choke 802 after the detachment of the choke 802 from the piston 808.

To illustrate, the choke adapter 804 may be attached to the piston 808 prior to the assembly of the percussion tool 1100 with the piston 808 disposed within the percussion tool 1100. For example, the choke adapter 804 may be press fit into the piston opening 816 as described above. The choke 802 may also be attached to the choke adapter 804 and thus to the piston 808 prior to the assembly of the percussion tool 1100. Once the percussion tool 1100 is assembled, the choke 802 that is initially attached to the choke adapter 804 may need to be changed for various reasons such as defects or the need to change the flow of fluid to the piston 808. For example, the choke 802 may need to be replaced with the replacement choke 1114 of FIGS. 11C and 11D that has a different dimension of the choke opening 904 shown in FIG. 9A. Alternatively, the replacement choke 1114 may be substantially the same as the choke 802 and the choke 802 may need to be replaced due to damage, for example, from ordinary wear and tear.

Referring to FIG. 11A, to remove the choke 802 from the choke adapter 804, the choke adapter tool 806 may be attached to the choke 802 by lowering the choke adapter tool 806 through the passageway 1106 of the percussion tool 1100. In some example embodiments, the passageway 1106 is also a passageway through the top sub 1104. Once the choke adapter tool 806 is attached to the choke 802, an operator (not shown) may rotate the choke change tool 806, for example, to unscrew the choke 802 from the choke adapter 804. For example, the choke change tool 806 may be attached to the choke 802 by inserting the arms 908 of the choke adapter tool 806 into the arm slots 906 of the choke 802 as illustrated in FIG. 9A. The operator may rotate the choke change tool 806 by rotating the rod 1110, for example, using a ratchet or another device (not shown) that is attached to a top end 1112 of the rod 1110 to decouple the choke 802 from the choke adapter 804. Once the choke 802 is decoupled from the choke adapter 804 and thus from the piston 808, the choke 802 may be removed from the percussion tool 1100 by pulling the rod 1110. FIG. 11B illustrates the choke 802 as the choke 802 is being removed from the percussion tool 1100 through the passageway 1106 after the choke is detached from the piston 808.

Figure 11C:
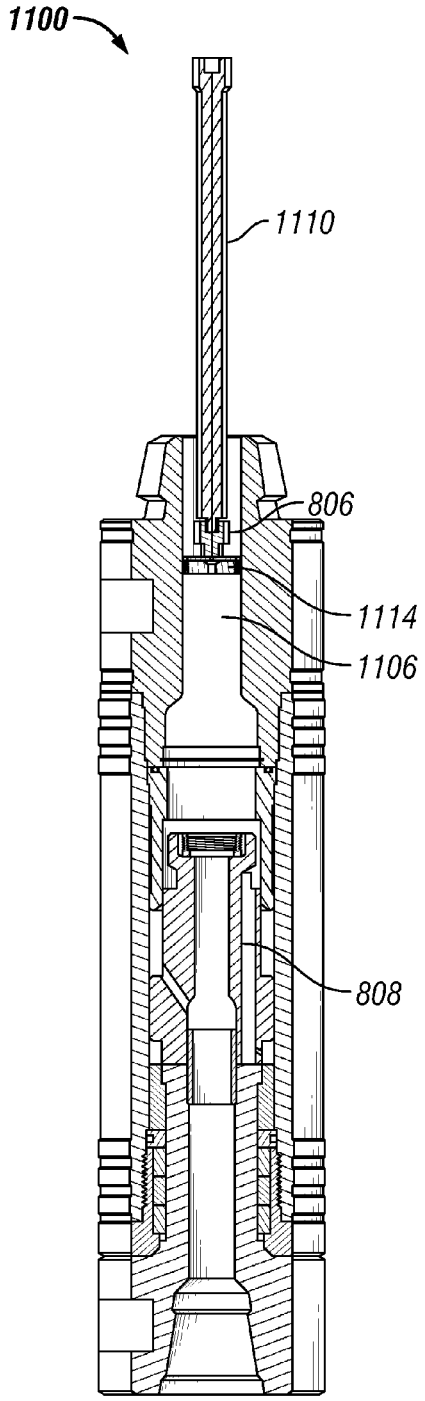

FIG. 11C illustrates the choke 802 after removal of the choke 802 as described above and prior to the attachment of the replacement choke 1114 to the piston 808. The replacement choke 1114 is attached to the choke change tool 806 in the manner illustrated in FIG. 9A. As illustrated in FIG. 11C, the replacement choke 1114 is being lowered toward the piston 808 by lowering the choke change tool 806 and rod 1110 through the passageway 1106 of the percussion tool 1100.

Figure 11D:
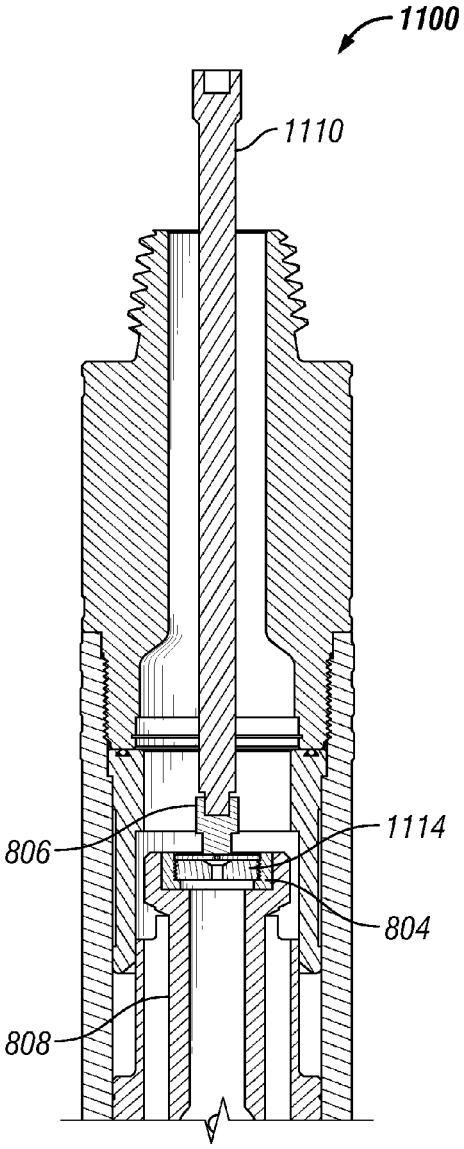

FIG. 11D illustrates the replacement choke 1114 being attached to the choke adapter 804 and thus to the piston 808. Similar to the removal process of the choke 802, an operator may rotate the choke change tool 806 by rotating the rod 1110 to screw the replacement choke 1114 into the choke adapter 804. Once the replacement choke 1114 is fully screwed into the choke adapter 804, the choke change tool 806 may be removed from the replacement choke 1114 by pulling the rod 1110. Once the choke change tool 806 is removed from the replacement choke 1114, the choke change tool 806 and the rod 1110 may be pulled out of the percussion tool 1100 through the passageway 1106. As described above, the replacement choke 1114 may be substantially the same as the choke 802 or may be substantially the same as the choke 802 except for some differences such as the dimension of the choke opening 904 shown in FIG. 9A.

In some alternative embodiments, the choke 802 may be designed such that the choke 802 is not flush with the choke adapter 804. In such alternative exemplary embodiments, a different choke change tool that can attach to the outer wall 812 of the choke 802 or to structures such as openings in the outer wall may be used to attach and detach the choke 802 to/from the choke adapter 804.

As illustrated in FIGS. 11A-11D, the choke 802 may be replaced without dismantling the downhole percussion tool 1100. For example, the choke 802 may be replaced without dismantling the top sub 1104 from the casing 1102. Thus, by using the choke 802 in a percussion tool, such as the percussion tool 1100, the choke 802 may be replaced in the field relatively quickly and without requiring heavy machinery or consuming too much time.

Figure 13:
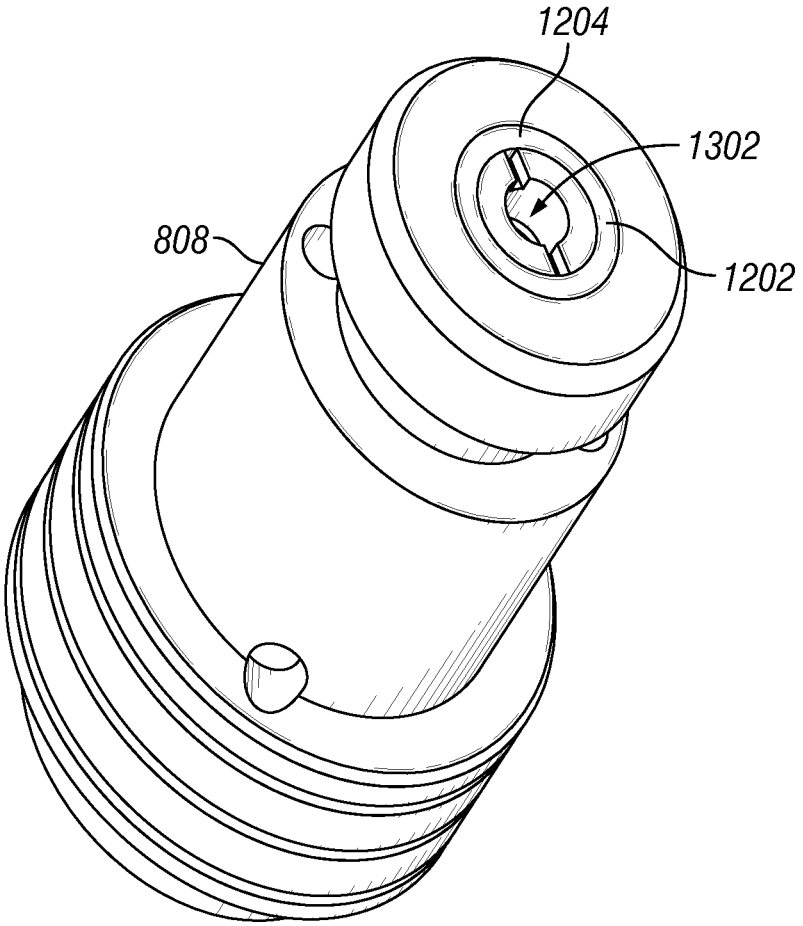
FIG. 13 illustrates the choke and the choke adapter of FIG. 12 after attachment to a piston of a percussion tool in accordance with an exemplary embodiment of the present invention.

FIG. 12 illustrates a choke 1202 and a choke adapter 1204 prior to attachment to the piston 808 in accordance with another exemplary embodiment of the present invention. FIG. 13 illustrates the choke 1202 and the choke adapter 1204 of FIG. 12 after attachment to the piston 808 in accordance with an exemplary embodiment of the present invention. Referring to FIGS. 12 and 13, the choke 1202 includes a choke body 1212 and a choke opening 1302. The choke 1202 may be designed with the choke opening 1302 having different sizes/diameter. The choke opening 1302 is surrounded by an inner wall 1216 of the choke body 1212. Arm slots 1210 are formed in the choke body 1212. The arm slots 1210 are designed to receive arms of a choke change tool, such as a choke change tool 1700 shown in FIGS. 17A and 17B. In some example embodiments, the arm slots 1210 are positioned across from each other with respect to the choke opening 1302 shown in FIG. 13.

The choke adapter 1204 is designed to be inserted into the piston opening 816. The choke adapter 1204 is also designed to receive the choke 1202 in an adapter opening 1218. In some exemplary embodiments, the choke adapter 1204 includes detent holes 1220 that are designed to receive detents 1222. Once inserted in the detent holes 1220 following the attachment of the choke 1202 with the choke adapter 1204, the detents 1222 are designed to prevent the choke 1202 from unintendedly rotating from a locked position after the choke 1202 as illustrated in FIG. 13.

In some exemplary embodiments, the choke adapter 1204 may be flush with the top surface of the piston 808 when the choke adapter 1204 is fully inserted into the piston 808 as illustrated in FIG. 13. Similarly, the choke 1202 may be flush with the choke adapter 1204 when the choke 1202 is fully inserted into the choke adapter 1204 as illustrated in FIG. 13.

In some exemplary embodiments, the choke 1202 may be made from the same material and in a similar manner as the choke 802 of FIG. 8A. The choke adapter 1204 may also be made from the same material and in a similar manner as the choke adapter 804 of FIG. 8A.

Although the choke adapter 1204 has a substantially circular outer shape, in alternative embodiment, the choke adapter 1204 may have other outer shapes that correspond to the piston opening 816. Further, the choke adapter 1204 may have fewer or more detent holes 1220 than shown in FIG. 12 without departing from the scope of this disclosure. Furthermore, the choke opening 1302 may have other shapes than shown in FIG. 13 without departing from the scope of this disclosure.

Figure 14A:
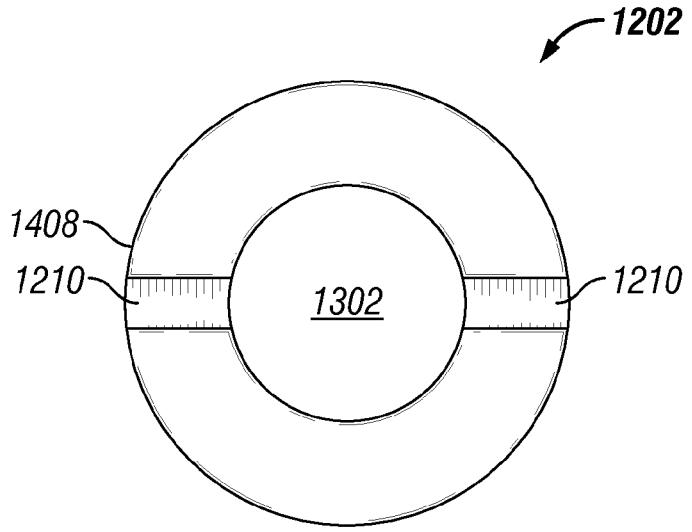
FIGS. 14A-14C illustrate different views of the choke of FIG. 12 in accordance with an exemplary embodiment of the present invention.
Figure 14B:
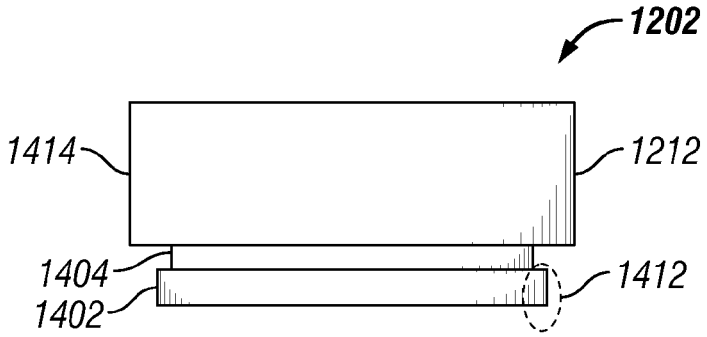
Figure 14C:
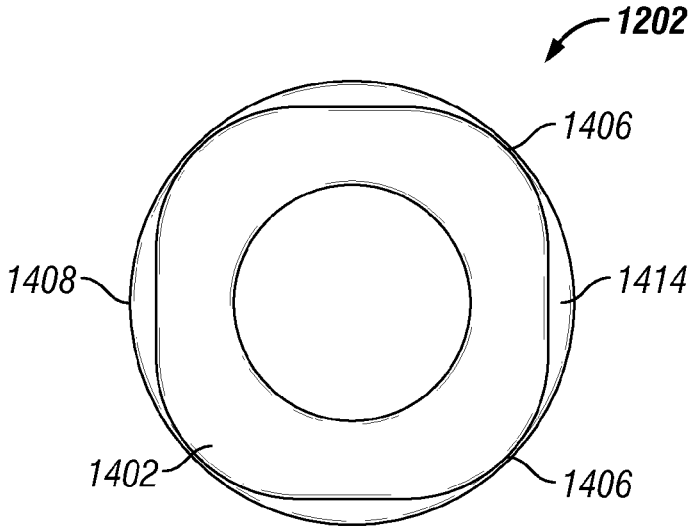

FIGS. 14A-14C illustrate different views of the choke 1202 of FIG. 12 in accordance with an exemplary embodiment of the present invention. As illustrated in FIG. 14A, which shows a top view of the choke 1202, the arm slots 1210 are formed on the top end of the choke body 1212. The arm slots 1210 extend from the inner wall 1216 shown in FIG. 12 to the outer perimeter of the choke body 1212. In some alternative embodiments, the arm slots 1210 may be shorter than shown in FIG. 14A and may not extend all the way to one or both the inner wall 1216 (shown in FIG. 12) and the outer perimeter 1408 of the choke body 1212.

FIG. 14B illustrates a side view of the choke 1202. In some exemplary embodiments, the choke body 1212 of the choke 1202 may include a bottom segment 1402, a top segment 1414, and a middle segment 1404 formed between the bottom segment 1402 and the top segment 1414 as illustrated in FIG. 14B. The middle segment 1404 may form a single channel around the choke body 1212 between the bottom segment 1402 and the top segment 1414. Alternatively, the middle segment 1404 may form a number of discontinuous channels around the choke body 1212. Similarly, the bottom segment 1402 may have one or more protrusions 1412 that protrude out horizontally as illustrated in FIG. 14B. For example, the bottom segment 1402 may have a single protrusion 1412 that extends around the choke body 1212. Alternatively, the bottom segment 1402 may have multiple protrusions 1412 that are discontinuous with respect to each other. As illustrated in FIG. 14C, which shows a bottom view of the choke 1202, the bottom segment 1402 may have a substantially square outline with rounded corners 1406. In some exemplary embodiments, the protrusions 1412 may be formed only at the rounded corners 1406.

Figure 15A:
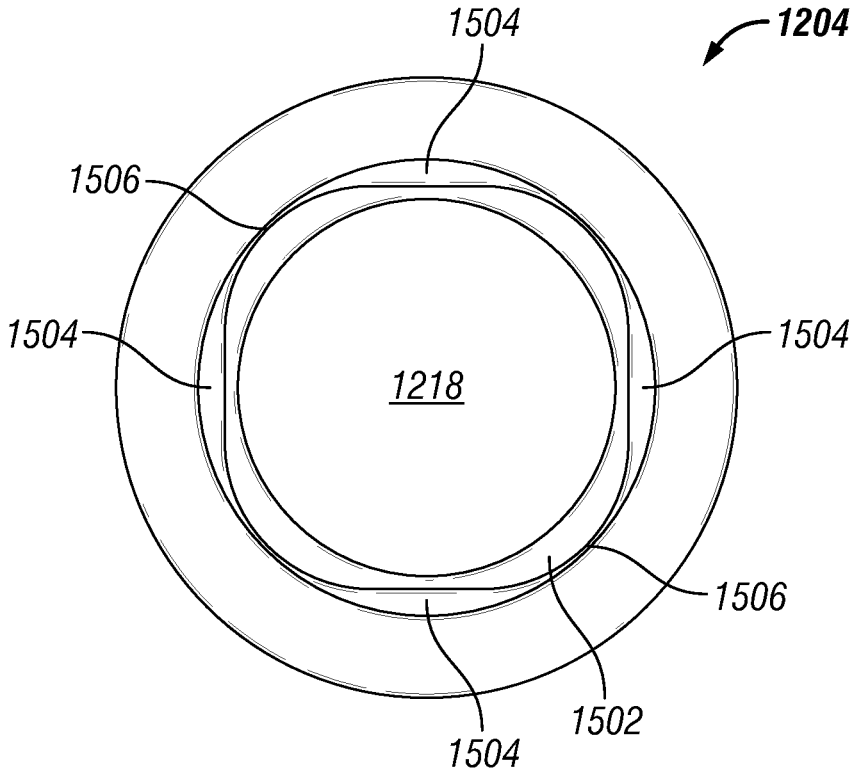
FIG. 15A illustrates a top view of a choke adapter of FIG. 12 in accordance with an exemplary embodiment of the present invention.
Figure 15B:
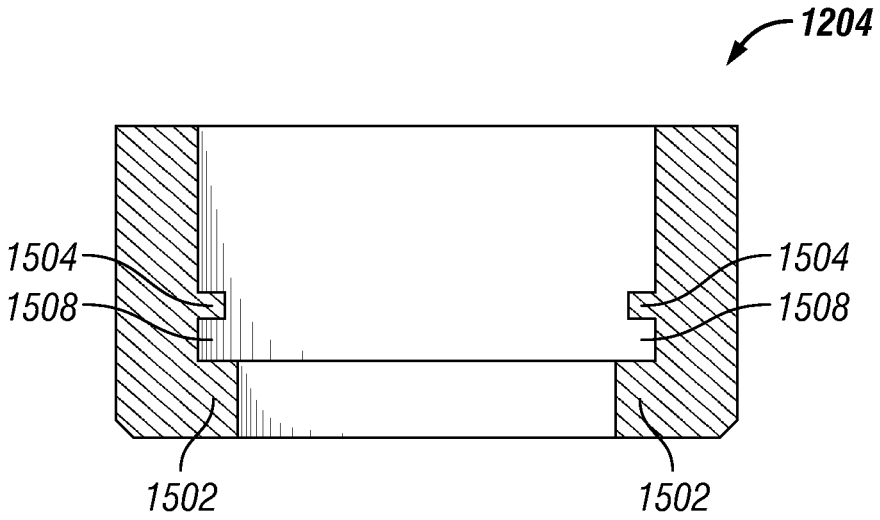
FIG. 15B illustrates a cross-sectional view of the choke adapter of FIG. 12 in accordance with an exemplary embodiment of the present invention.

FIG. 15A illustrates a top view of a choke adapter 1204 of FIG. 12 in accordance with an exemplary embodiment of the present invention. FIG. 15B illustrates a cross-sectional view of the choke adapter 1204 of FIG. 12 in accordance with an exemplary embodiment of the present invention. Referring to FIGS. 15A and 15B, the choke adapter 1204 has a substantially circular shape. The choke adapter 1204 includes a bottom portion 1502 that is also substantially circular. The choke adapter 1204 also has a middle portion 1504 that is substantially square shaped with rounded corners 1506. The middle portion 1504 is shaped such that the bottom segment 1402 of the choke body 1212 shown in FIGS. 14B and 14C can be inserted into the choke opening 1302 and rest on the bottom portion 1502. For example, to insert the choke 1202, the choke body 1212 can be oriented such that the rounded corners 1406 of the bottom segment 1402 of the choke body 1212 are aligned with the rounded corners 1506 of the middle portion 1504 of the choke adapter 1204.

As more clearly illustrated in FIG. 15B, the middle portion 1504 and the bottom portion 1502 form one or more channels 1508 for receiving the protrusion 1412 of the choke body 1212. For example, the middle portion 1504 and the bottom portion 1502 may form a single continuous channel or multiple channels 1508 that are discontinuous from each other. For example, multiple channels 1508 may be formed between the rounded corners 1506 but not at the rounded corners themselves.

After the choke 1202 is inserted into the choke adapter 1204 as described above, the choke 1202 may be rotated 45 degrees, clockwise or counterclockwise, such that the one or more protrusions 1412 are positioned in the one or more channels 1508. For example, when choke is rotated 45 degrees, the rounded corners 1406 of the bottom segment 1402 of the choke body 1212 may be positioned substantially equal distance between the rounded corners 1506 of the middle portion 1504. Alternatively, the choke 1202 may be rotated less or more than 45 degrees without departing from the scope of this disclosure. The choke 1202 may be rotated as described above using choke change tool 1700 illustrated in FIGS. 17A and 17B.

Figure 16A:
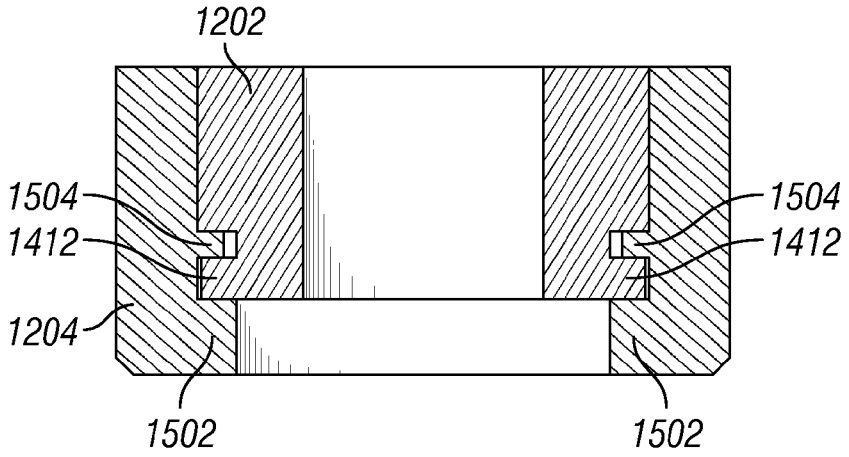
FIGS. 16A and 16B illustrate different views of the choke of FIG. 12 attached to the choke adapter in accordance with another exemplary embodiment of the present invention.
Figure 16B:
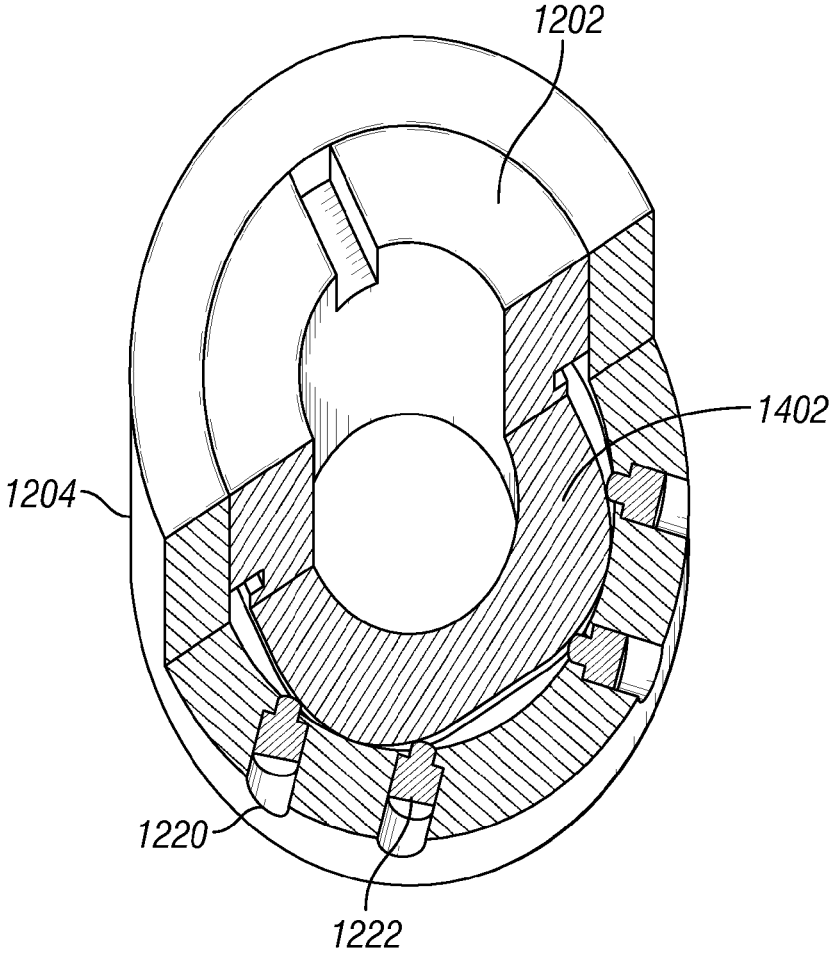

FIGS. 16A and 16B illustrate different views of the choke 1202 of FIG. 12 attached to the choke adapter 1204 in accordance with another exemplary embodiment of the present invention. After choke 1202 is inserted into the choke adapter 1204 and rotated, for example, 45 degrees as described above with respect to FIGS. 15A and 15B, the choke 1202 is locked in position such that the choke 1202 is prevented from a vertical motion by the middle portion 1504 and the bottom portion 1502. To illustrate, the one or more protrusions 1412 of the bottom segment 1402 of the choke 1202 are positioned in the one or more channels 1508 shown in FIG. 15B such that the choke 1202 is prevented from moving in the vertical direction. Similarly, the middle portion 1504 may be positioned against the middle segment 1404 (more clearly illustrated in FIG. 14B) to further prevent vertical motion of the choke 1202 after the choke 1202 is rotated, for example, 45 degrees.

As illustrated in FIG. 16B, the detents 1222 that are inserted in the detent holes 1220 serve to prevent unintended rotation of the choke 1202 that may result in the unlocking of the choke 1202 from the choke adapter 1204. To intentionally unlock the choke 1202 from the choke adapter 1204, the choke 1202 may be rotated, for example, 45 degrees with adequate force to overcome the resistance applied by the detents. For example, the choke 1202 may be rotated such that the rounded corners 1406 (more clearly shown in FIG. 14C) of the choke 1202 may be aligned with the rounded corners 1506 of the middle portion 1504 (shown in FIG. 16A) of the choke adapter 1204 such that the choke 1202 can be pulled out of the choke adapter 1204. The choke 1202 can be rotated and pulled out of the choke adapter 1204 using the choke change tool 1700 shown in FIGS. 17A and 17B.

Figure 17A:
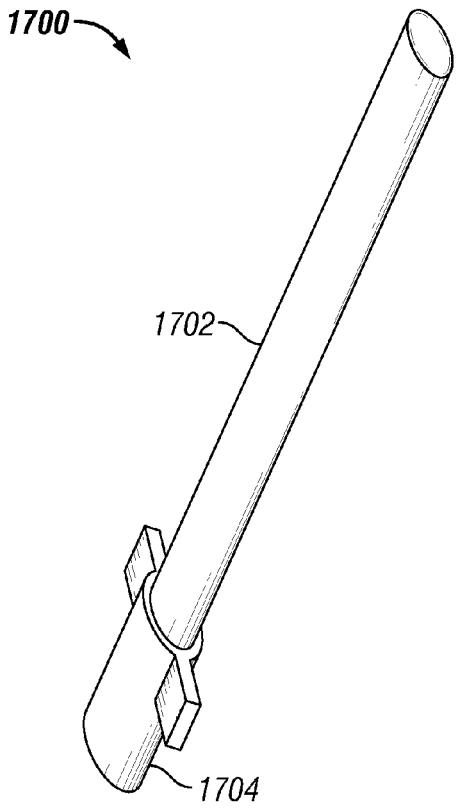
FIGS. 17A-17C illustrate views of a choke change tool for installation and removal of the choke of FIG. 12 into and out of the choke adapter in accordance with an exemplary embodiment of the present invention.
Figure 17B:
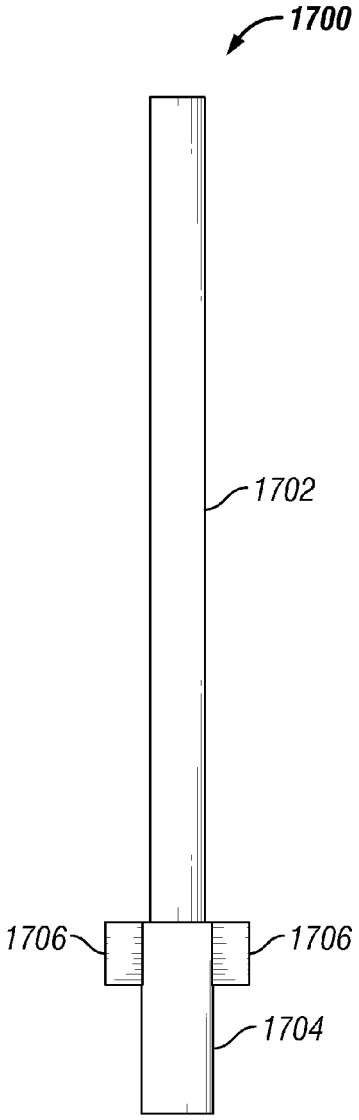
Figure 17C:
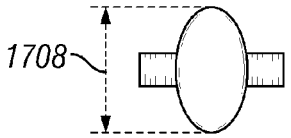

FIGS. 17A-17C illustrate different views of the choke change tool 1700 used for installation and removal of the choke 1202 of FIG. 12 into and out of the choke adapter 1204 in accordance with an exemplary embodiment of the present invention. As illustrated in FIGS. 17A and 17B, the choke change tool 1700 includes a rod 1702 and a tip portion (lower segment) 1704. The tip portion 1704 may be a separate component that is attached to the rod 1702. Alternatively, the tip portion 1704 may be integrally formed with the rod 1702. The choke change tool 1700 also includes arms 1706 that are designed to fit into respective arm slots 1210 of FIG. 12. For example, the arms 1706 may extend out from the tip portion 1704 as illustrated in FIG. 17A. Alternatively, the arms 1706 may extend out from the rod 1702.

In some exemplary embodiments, the tip portion 1704 may have a diameter 1708 that slightly smaller than the diameter of the choke opening 1302 that is shown, for example, in FIG. 14A. For example, the diameter 1708 of the tip portion 1704 may be sized such that at least a portion of the tip portion 1704 fits grippingly in the choke opening 1302 of the choke 1202 shown in FIGS. 12 and 13. Similarly, the arms 1706 may have dimensions that fittingly match respective dimensions of the arm slots 1210 shown in FIG. 12. For example, the tip portion 1704 may be made from a material (e.g., rubber) that can grip, through friction, to the inner wall 1216 of the choke 1202 when at least a portion of the choke change tool 1700 (i.e., at least a portion of the tip portion 1704) is inserted into the choke opening 1302. In some exemplary embodiments, the arms 1706 may also be made from the same material as the tip portion 1704. The arms 1706 are typically inserted into the respective arm slots 1210 of the choke 1202 when the choke change tool 1700 is attached to the choke 1202.

To attach a choke 1202 to a choke adapter 1204 and thus the piston 808 of a percussion tool, such as the percussion tool 1100, the choke change tool 1700 may be attached to the choke 1202 as described above, and the choke 1202 may be inserted into the choke adapter 1204 and rotated (for example, 45 degrees) by the choke change tool 1700 to lock the choke 1202 in the choke adapter 1204. To remove the choke 1202 from the choke adapter 1204, the choke change tool 1700 may be attached to the choke 1202 and rotated, for example, 45 degrees as described above with respect to FIGS. 16A and 16B.

The percussion tool 1100 of FIGS. 11A-11D may include the choke 1202 instead of the choke 802. In such embodiment, the choke 1202 that is installed in the percussion tool 1100 may be replaced by a replacement choke in a substantially the same manner described with respect to FIGS. 11A-11D. For example, the choke change tool 1700 may hold the choke 1202 or a replacement choke 1202 with a friction-based grip to remove the choke 1202 out of the percussion tool 1100 or to lower the replacement choke 1202 toward the piston 808 of the percussion tool 1100.

In some example embodiments, the choke change tool 806 shown in FIG. 10 may be used for attachment and removal of the choke 1202 to/from the piston 808. For example, the choke change tool 806 may have two arms 908 or the choke 1202 may four arm slots 1210. Similarly, the choke change tool 1700 may be used for attachment and removal of the choke 802 to/from the piston 808.

Features described in certain exemplary embodiments described above may be incorporated in other exemplary embodiments also described above without departing from the scope of this disclosure. For example, the check valve 580 of FIGS. 5-6B and the check valve 700 of FIGS. 7A and 7B may be disposed upstream in relation to the piston 808, in the percussion tool 1100 of FIGS. 11A-11D.

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A choke assembly for controlling air flow into a piston of a percussion tool for downhole drilling, the choke assembly comprising:

a choke comprising:

a choke body;

a choke opening in the choke body for fluid to flow therethrough; and one or more arm slots formed into the choke body between an inner wall of the choke body and an outer wall of the choke body, wherein the one or more arm slots are designed to receive one or more arms of a choke change tool; and a choke adapter having an adapter opening extending through the choke adapter, wherein the choke is sized to fit in the adapter opening and wherein the choke is removable from the choke adapter after the choke is inserted into the adapter opening.

2. The choke assembly of claim 1, wherein the outer wall of the choke body is threaded, wherein an inner wall of the choke adapter is threaded, and wherein the choke is attachable to the choke adapter by screwing the choke into the choke adapter.

3. The choke assembly of claim 2, wherein the choke is attachable to the choke adapter using the choke change tool.

4. The choke assembly of claim 1, wherein each opening of the one or more arm slots is smaller than a diameter of each of the one or more arms of the choke change tool and wherein each arm of the one or more arms of the choke change tool is designed to be inserted into a respective arm slot of the one or more arm slots through a respective opening of the respective arm slot.

5. The choke assembly of claim 4, wherein each arm of the one or more arms of the choke change tool is designed to be removed from a respective arm slot of the one or more arm slots through the respective opening of the respective arm slot.

6. The choke assembly of claim 1, wherein the one or more arm slots are four arm slots and wherein the four arm slots are equally spaced around the perimeter of the choke opening.

7. The choke assembly of claim 1, wherein the choke comprises protrusions extending out horizontally at a bottom end of the choke body, wherein the choke is locked into the choke adapter by rotating the choke such that the protrusions are positioned in channels of the choke adapter.

8. The choke assembly of claim 7, wherein the choke adapter comprises one or more detent holes extending through the choke adapter, wherein one or more detents are inserted into the one or more detent holes, and wherein the one or more detents resist unlocking of the choke from the choke adapter by resisting rotation of the protrusions out of the channels.

9. The choke assembly of claim 1, wherein the one or more arm slots are two arm slots that are positioned across from each other with respect to the choke opening.

10. The choke assembly of claim 1, wherein the choke adapter is designed to be press fit into a piston of a percussion tool.

11. A percussion tool for downhole drilling, the percussion tool comprising:

a piston having a piston opening at an end of the piston;

a choke adapter positioned in the piston opening and attached to the piston, the choke adapter comprising an adapter opening;

a choke for restricting flow of a fluid into the piston and positioned in the adapter opening, the choke comprising:

a choke body; and a choke opening in the choke body, the choke opening forming a passageway for the fluid to flow into the piston, wherein an outer wall of the choke body is threaded, wherein an inner wall of the choke adapter is threaded, and wherein the choke is attached to the choke adapter by screwing the choke into the choke adapter;

a casing, wherein the piston is disposed in the casing and slidable relative to the casing;

a mandrel being supported within a lower portion of the casing, wherein the piston is operable to deliver an impact force onto the mandrel; and a top sub comprising a top sub passageway extending longitudinally therethrough and coupled to a top end of the casing, wherein the piston is positioned within the casing below the top sub, and wherein the choke is replaceable through the top sub passageway without dismantling the top sub from the casing.

12. The percussion tool of claim 11, wherein the choke adapter is attached to the piston by being press fit into the piston opening.

13. The percussion tool of claim 11, wherein the choke further comprises one or more arm slots formed into the choke body between an inner wall of the choke body and an outer wall of the choke body, wherein the one or more arm slots are designed to receive one or more arms of a choke change tool.

14. The percussion tool of claim 13, wherein each opening of the one or more arm slots is smaller than a diameter of each of the one or more arms of the choke change tool and wherein each arm of the one or more arms of the choke change tool is designed to be inserted into a respective arm slot of the one or more arm slots through a respective opening of the respective arm slot.

15. The percussion tool of claim 14, wherein each arm of the one or more arms of the choke change tool is designed to be removed from a respective arm slot of the one or more arm slots through the respective opening of the respective arm slot.

16. The percussion tool of claim 13, wherein the choke is removed from the choke adapter by inserting one or more corresponding arms of the choke change tool into the one or more arm slots and pulling the choke change tool.

17. The percussion tool of claim 13, wherein the one or more arm slots are four arm slots and wherein the four arm slots are equally spaced around the perimeter of the choke opening.

18. The percussion tool of claim 13, wherein the one or more arm slots are two arm slots that are positioned across from each other with respect to the choke opening.

19. A method of replacing a choke of a piston installed in a downhole percussion tool, the method comprising:

attaching a choke change tool to a choke through a passageway of a percussion tool, wherein the choke has a choke opening, wherein the choke is coupled to a choke adapter that is positioned in a piston opening of a piston, and wherein the piston is disposed in the downhole percussion tool;

decoupling the choke from the choke adapter using the choke change tool after attaching the choke change tool to the choke; and removing the choke from the percussion tool by pulling the choke change tool through the passageway of the percussion tool while the choke is attached to the choke change tool.

20. The method of claim 19, further comprising inserting a replacement choke into the choke adapter after removing the choke from the percussion tool.

21. The method of claim 20, wherein the choke change tool comprises one or more arms that are designed to be inserted into corresponding one or more arm slots formed in a body of the choke, wherein the one or more arms extend out substantially horizontally from a lower segment of the choke change tool.

22. The method of claim 21, wherein decoupling the choke from the choke adapter comprises rotating the choke change tool to unscrew the choke from the choke adapter.

23. The method of claim 21, wherein attaching the choke change tool to the choke comprises inserting at least a portion of the lower segment of the choke change tool into the choke opening.

24. The method of claim 23, wherein the lower segment of the choke change tool grips an inner wall of the choke, where the inner wall of the choke surrounds the choke opening.

25. The method of claim 21, wherein attaching the choke change tool further comprises snapping the one or more arms into the one or more arm slots.

26. The method of claim 20, further comprising detaching the choke change tool from the choke.

27. The method of claim 26, wherein detaching the choke change tool from the choke comprises snapping one or more arms of the choke change tool from one or more arm slots of the choke.

28. The method of claim 19, wherein the choke adapter is press fit into the piston opening.

29. A percussion tool for downhole drilling, the percussion tool comprising:

a piston having a piston opening at an end of the piston;

a choke for restricting flow of a fluid into the piston, positioned in the piston opening, and attached to the piston, the choke comprising:

a choke body; and a choke opening in the choke body, the choke opening forming a passageway for the fluid to flow into the piston, wherein an outer wall of the choke body is threaded, wherein an inner wall of the piston is threaded, and wherein the choke is attached to the piston by screwing the choke into the piston;

a casing, wherein the piston is disposed in the casing and slidable relative to the casing;

a mandrel being supported within a lower portion of the casing, wherein the piston is operable to deliver an impact force onto the mandrel; and a top sub comprising a top sub passageway extending longitudinally therethrough and coupled to a top end of the casing, wherein the piston is positioned within the casing below the top sub, and wherein the choke is replaceable through the top sub passageway without dismantling the top sub from the casing.

30. A percussion tool for downhole drilling, the percussion tool comprising:

a piston having a piston opening at an end of the piston;

a casing, wherein the piston is disposed in the casing and slidable relative to the casing;

a mandrel being supported within a lower portion of the casing, wherein the piston is operable to deliver an impact force onto the mandrel;

a top sub comprising a top sub passageway extending longitudinally therethrough and coupled to a top end of the casing, wherein the piston is positioned within the casing below the top sub;

a choke adapter positioned in the piston opening and attached to the piston regardless of a position of the piston relative to the casing, the choke adapter comprising an adapter opening; and a choke for restricting flow of a fluid into the piston and positioned in the adapter opening, the choke comprising:

a choke body; and a choke opening in the choke body, the choke opening forming a passageway for the fluid to flow into the piston, wherein the choke is replaceable through the top sub passageway without dismantling the top sub from the casing.

31. A percussion tool for downhole drilling, the percussion tool comprising:

a piston having a piston opening at an end of the piston;

a casing, wherein the piston is disposed in the casing and slidable relative to the casing;

a mandrel being supported within a lower portion of the casing, wherein the piston is operable to deliver an impact force onto the mandrel;

a top sub comprising a top sub passageway extending longitudinally therethrough and coupled to a top end of the casing, wherein the piston is positioned within the casing below the top sub; and a choke for restricting flow of a fluid into the piston, positioned in the piston opening, and attached to the piston regardless of a position of the piston relative to the casing, the choke comprising:

a choke body; and a choke opening in the choke body, the choke opening forming a passageway for the fluid to flow into the piston, wherein the choke is replaceable through the top sub passageway without dismantling the top sub from the casing.

* * * * *